US012286975B2

(12) United States Patent
Koenig et al.

(10) Patent No.: US 12,286,975 B2
(45) Date of Patent: Apr. 29, 2025

(54) SMART FAN FOR BUILDING DIAGNOSTIC TESTING

(71) Applicant: The Energy Conservatory, Inc., Minneapolis, MN (US)

(72) Inventors: Kris H. Koenig, Minneapolis, MN (US); Eric Mueller, Minneapolis, MN (US); Steven B. Rogers, Minneapolis, MN (US); Clay Hansen, Minneapolis, MN (US); Samuel Alan Englund, Minneapolis, MN (US)

(73) Assignee: The Energy Conservatory, Inc., Minneapolis, MN (US)

( * ) Notice: Subject to any disclaimer, the term of this patent is extended or adjusted under 35 U.S.C. 154(b) by 0 days.

(21) Appl. No.: 18/314,426

(22) Filed: May 9, 2023

(65) Prior Publication Data

US 2023/0358245 A1 Nov. 9, 2023

Related U.S. Application Data

(60) Provisional application No. 63/364,379, filed on May 9, 2022.

(51) Int. Cl.

| | |
|---|---|
| ***F04D 25/08*** | (2006.01) |
| ***F04D 19/00*** | (2006.01) |
| ***F04D 27/00*** | (2006.01) |
| ***F04D 29/00*** | (2006.01) |

(52) U.S. Cl.

CPC ..... *F04D 25/08* (2013.01); *F04D 19/002* (2013.01); *F04D 27/001* (2013.01); *F04D 29/002* (2013.01)

(58) Field of Classification Search

CPC ..... F04D 25/08; F04D 19/002; F04D 27/001; F04D 15/0022; F24F 11/30

See application file for complete search history.

(56) References Cited

U.S. PATENT DOCUMENTS

| | | | | |
|---|---|---|---|---|
| 3,015,216 | A * | 1/1962 | Coblentz | F24F 11/43 62/97 |
| 7,331,852 | B2 * | 2/2008 | Ezell | F24F 11/74 454/239 |
| 8,757,008 | B1 * | 6/2014 | Nelson | G01F 1/44 73/861 |
| 9,188,508 | B1 * | 11/2015 | Meyer | G01M 99/005 |
| 10,001,288 | B1 * | 6/2018 | Yang | F24F 11/79 |
| 2012/0054124 | A1 * | 3/2012 | Rodrigues | G06Q 50/06 702/136 |
| 2019/0282771 | A1 * | 9/2019 | Higashiyama | F04D 27/00 |
| 2020/0217551 | A1 * | 7/2020 | Vogel | F24F 11/89 |
| 2022/0042517 | A1 * | 2/2022 | Lazar | F04D 29/661 |

OTHER PUBLICATIONS

T-E-C, Minneapolis Blower Door, The Energy Conservatory, 2023, 9 pages https://store.energyconservatory.com/products/minneapolis-blower-door.html.

Partial European Search Report issued in corresponding European Patent Application No. 23186751.6, Jul. 26, 2024, 11 pages.

Extended European Search Report issued in corresponding European Patent Application No. 23186751.6, Oct. 17, 2024, 10 pages.

* cited by examiner

*Primary Examiner* — Justin D Seabe
*Assistant Examiner* — Jackson N Gillenwaters
(74) *Attorney, Agent, or Firm* — HSML P.C.

(57) ABSTRACT

Smart fans are described that can be used in any application in which a flow of a fluid, such as air, is required. In two specific applications, one or more of the fans can be used to conduct a blower door test or a duct leakage test. However, the smart fans described herein can be used in other applications.

13 Claims, 26 Drawing Sheets

SMART FAN FOR BUILDING DIAGNOSTIC TESTING

FIELD

This technical disclosure relates to a smart fan (also referred to as a smart blower) that can be used in a number of applications including, but not limited to, conducting blower door tests and duct leakage tests.

BACKGROUND

The use of fans for creating air flow in various applications is well known. Two example uses of fans is in conducting blower door tests and conducting duct leakage tests. A blower door test is conducted to measure the airtightness of a building. A duct leakage test is conducted to measure the airtightness of forced air heating, ventilating and air-conditioning (HVAC) ductwork. In both blower door tests and duct leakage tests, one or more fans are used during the test to generate a flow of air.

SUMMARY

Improvements to fans (or blowers) are described herein. The fans described herein may be referred to as smart fans and can be used in any application in which a flow of a fluid, such as air, is required. In two specific applications, improvements to blower door tests and/or duct leakage tests that use the fan(s) are described herein. However, the smart fans (or just fans) described herein can be used in other applications.

In one embodiment described herein, the fan(s) can be in one-way or two-way wireless or wired communication with a controller. Certain data regarding the fan can be transmitted to the controller. For example, the fan can removably receive different flow restrictors or include a variable flow restrictor (such as a variable flow control valve), and can send information on the flow restrictor or the position of the variable flow restrictor to the controller. The fan can also detect the presence of a duct connected thereto (for example when used for duct leakage testing) or detect a flow conditioner connected thereto, and send a suitable signal to the controller indicating that the duct or flow conditioner are connected (or conversely not connected). The fan may also send a fan identification signal to the controller that identifies the fan. The fan may also send various sensor signals to the controller such as a pressure signal relating to a pressure detected by a pressure sensor of the fan.

In addition, the controller can send data and/or control commands to the fan. For example, the controller can send a speed control signal to the fan to control the speed of the fan. The controller can also send data to the fan which can store the data in suitable data storage. For example, the data can be data on the flow restrictor used in the fan, the position of the variable flow restrictor, one or more pressure readings obtained by the pressure sensor, and the like. Some or all of this data may also be obtained by the fan and directly stored in the data storage on the fan without the data being sent from the controller.

In another embodiment, a power management circuit can be provided which allows a plurality of the fans to be powered by a single wall outlet, by a single battery that is remote from the fans, or by a single outlet of a generator. This embodiment is particularly useful in allowing use of a plurality of the fans in a blower door test.

DRAWINGS

Figure 10:
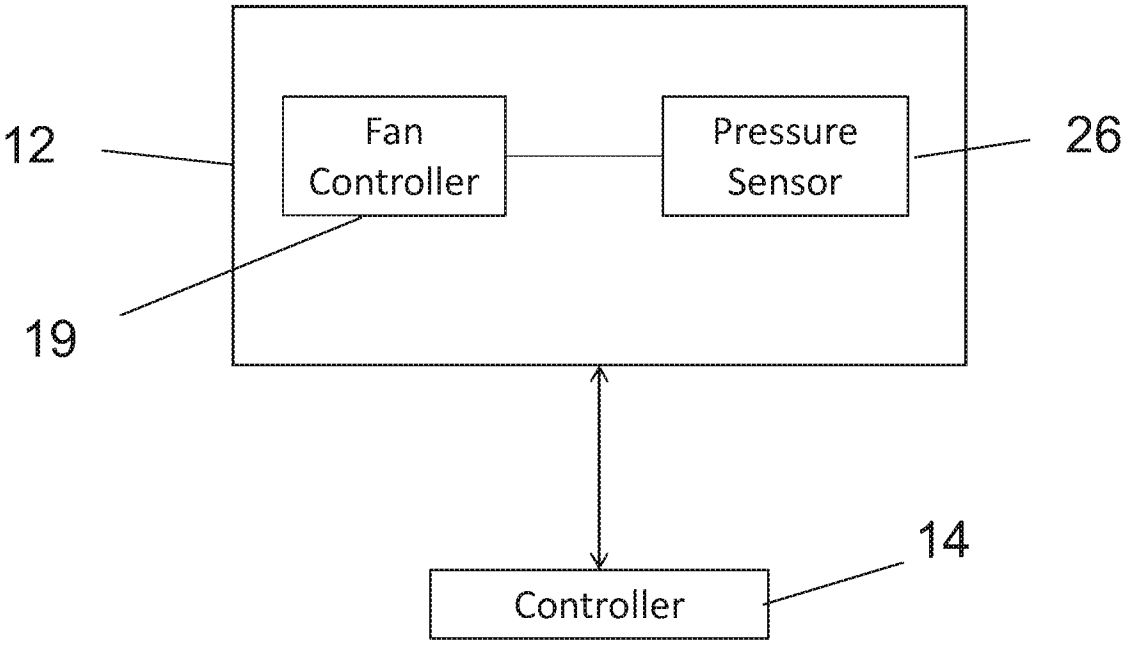

FIG. 10 schematically illustrates using flow sensor data and other data to determine operating conditions of the fan.

Figure 11A:
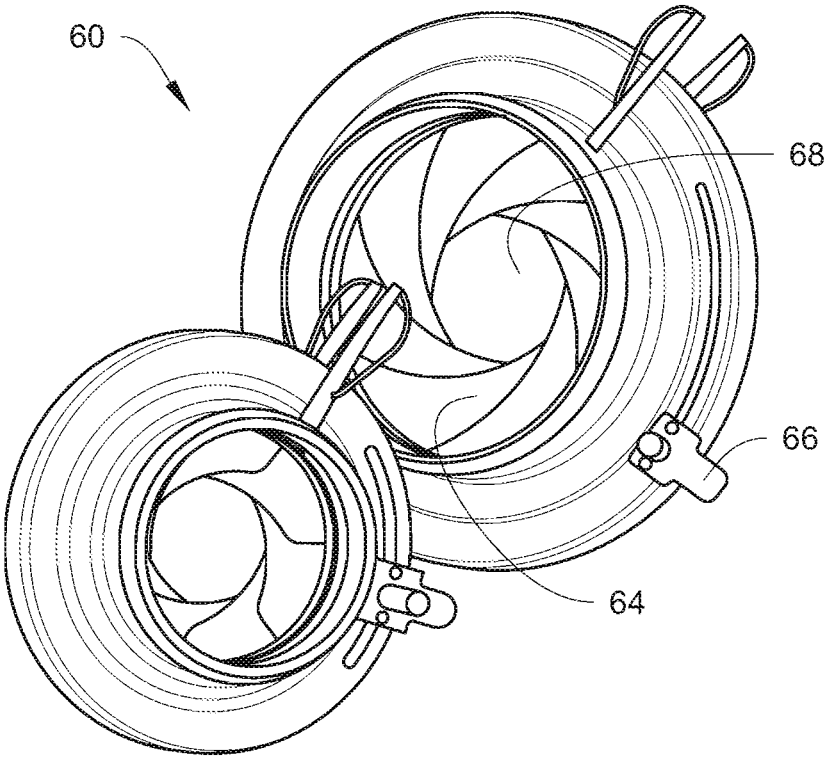
Figure 11B:
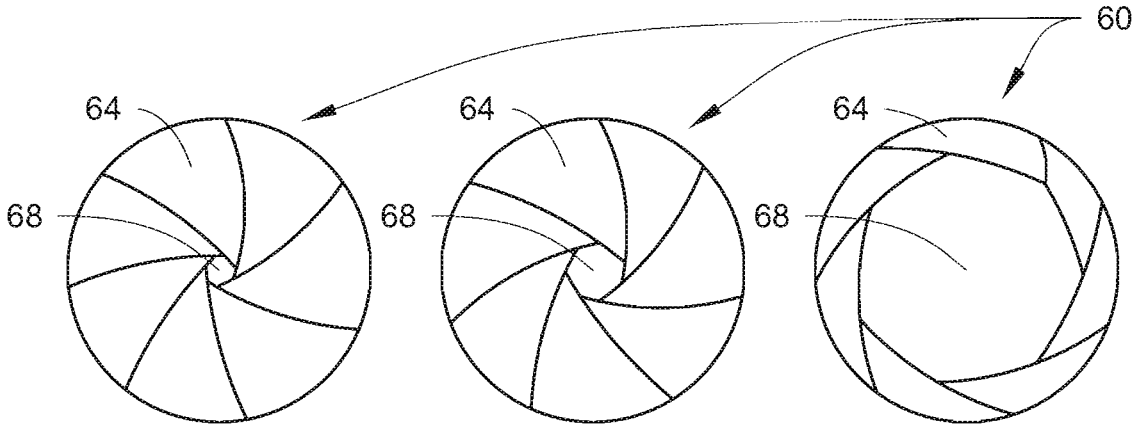

FIGS. 11A and 11B depict an example of a variable flow restrictor in the form of a variable flow control iris valve that can be used to adjust flow through the fan.

Figure 12:
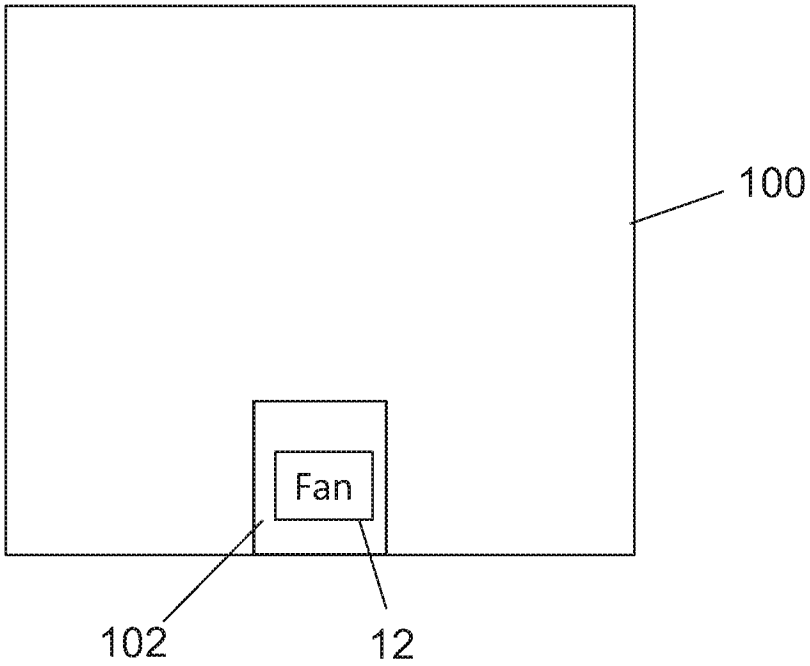

FIG. 12 is a schematic depiction of the smart fan described herein set-up to conduct a blower door test on a building.

Figure 13:
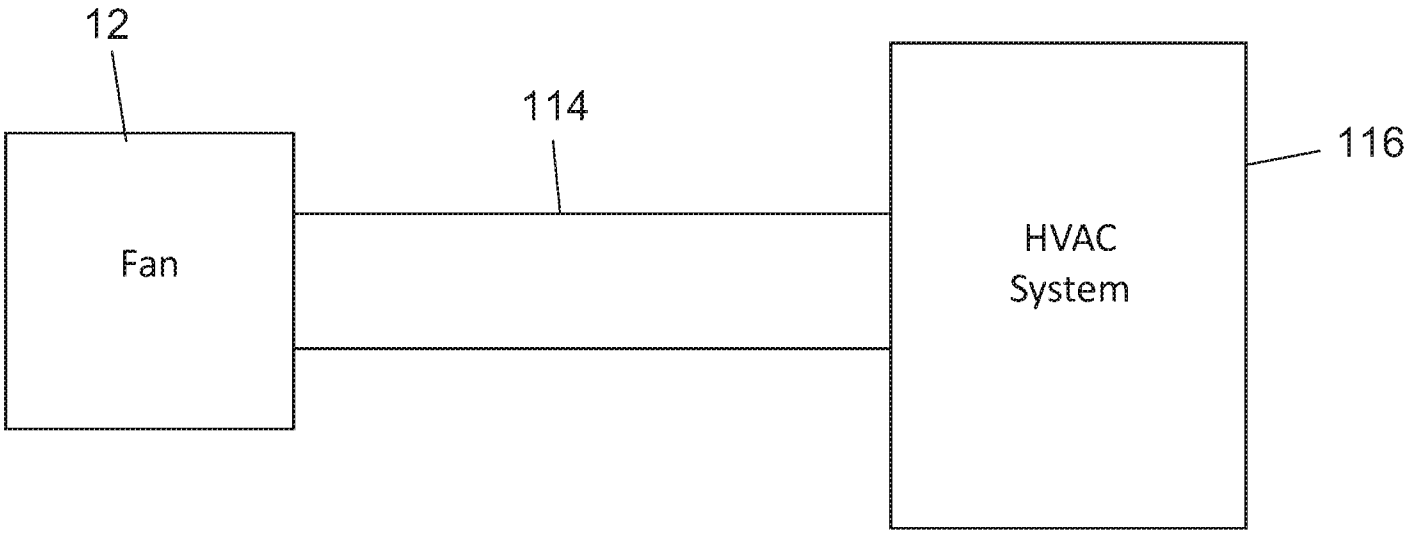

FIG. 13 is a schematic depiction of the smart fan described herein set-up to conduct a duct leakage test on an HVAC system installed in a building.

Figure 14:
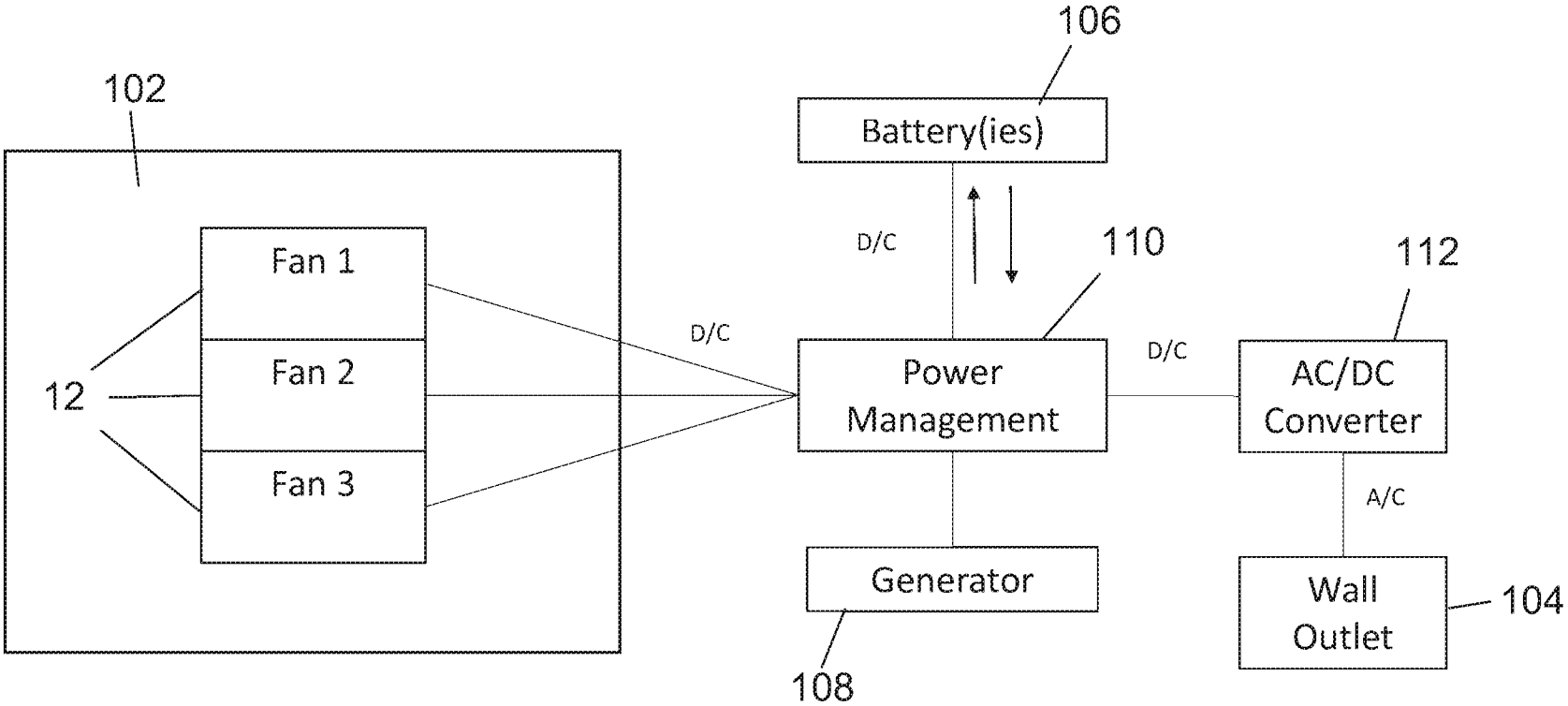

FIG. 14 is a schematic depiction of a plurality of fans set-up to conduct a blower door test.

Figure 15:
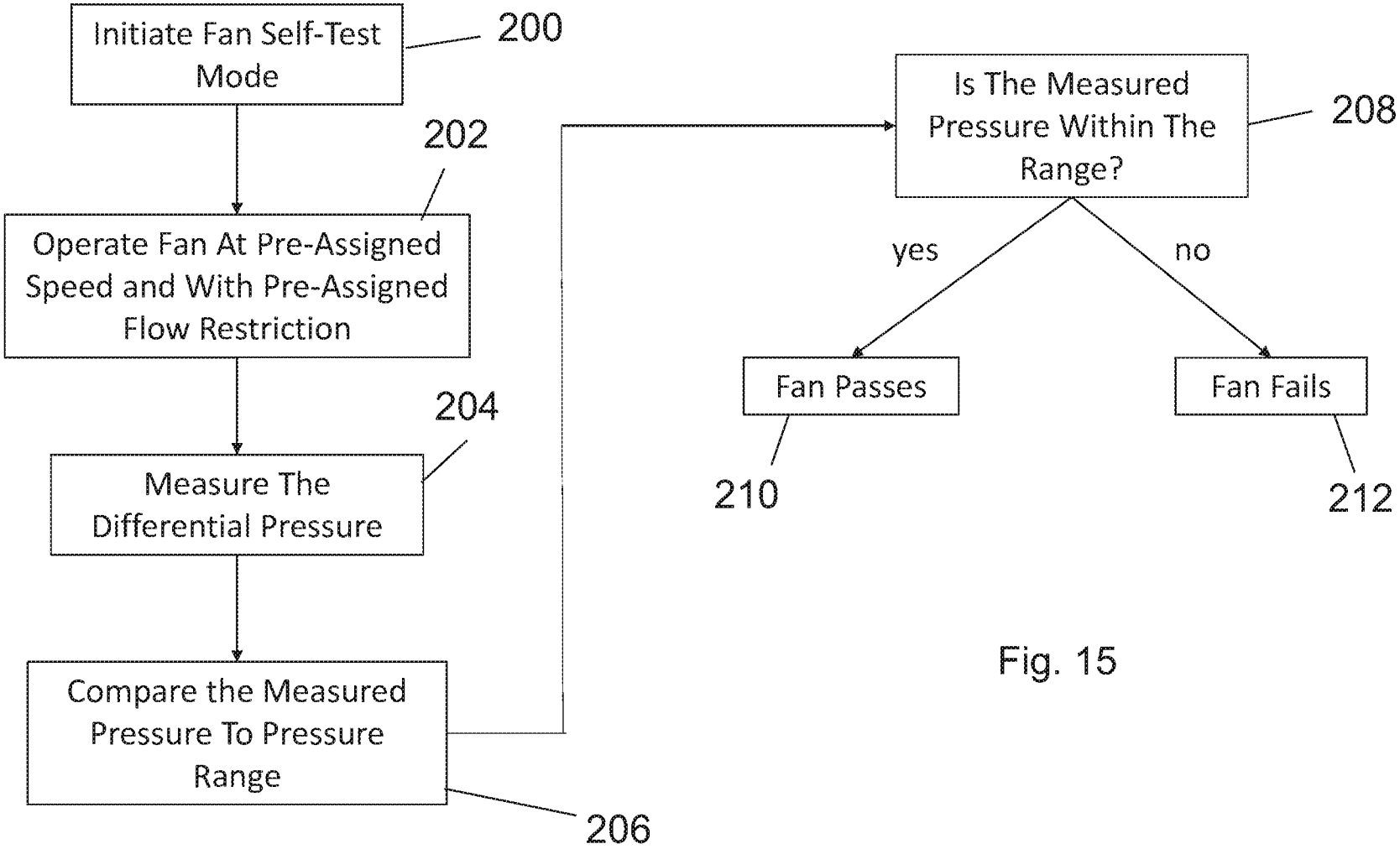

FIG. 15 illustrates an example of a fan self-test mode that can implemented by the smart fan described herein.

Figure 16:
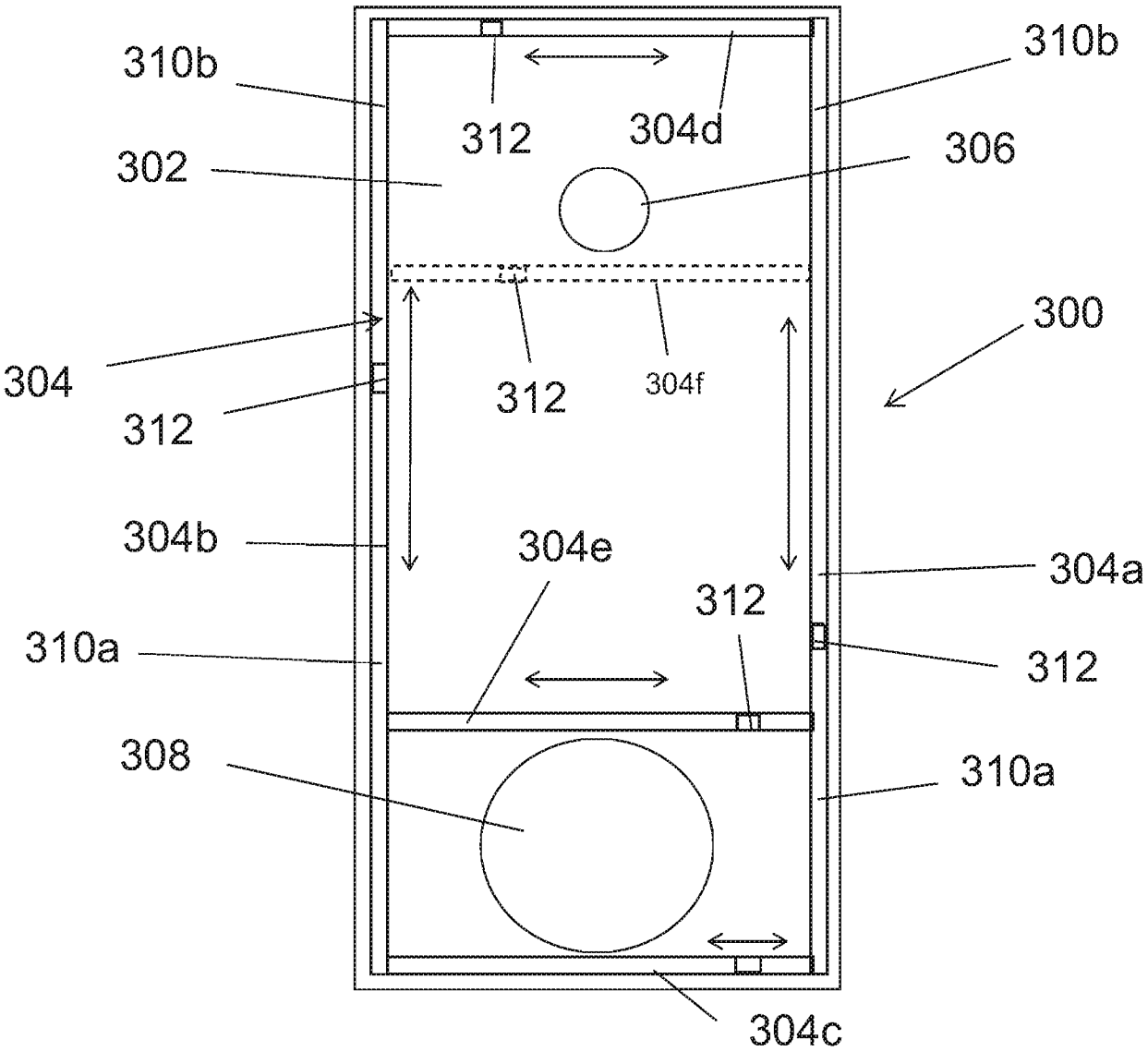

FIG. 16 illustrates an example embodiment of a new blower door panel.

Figure 17:
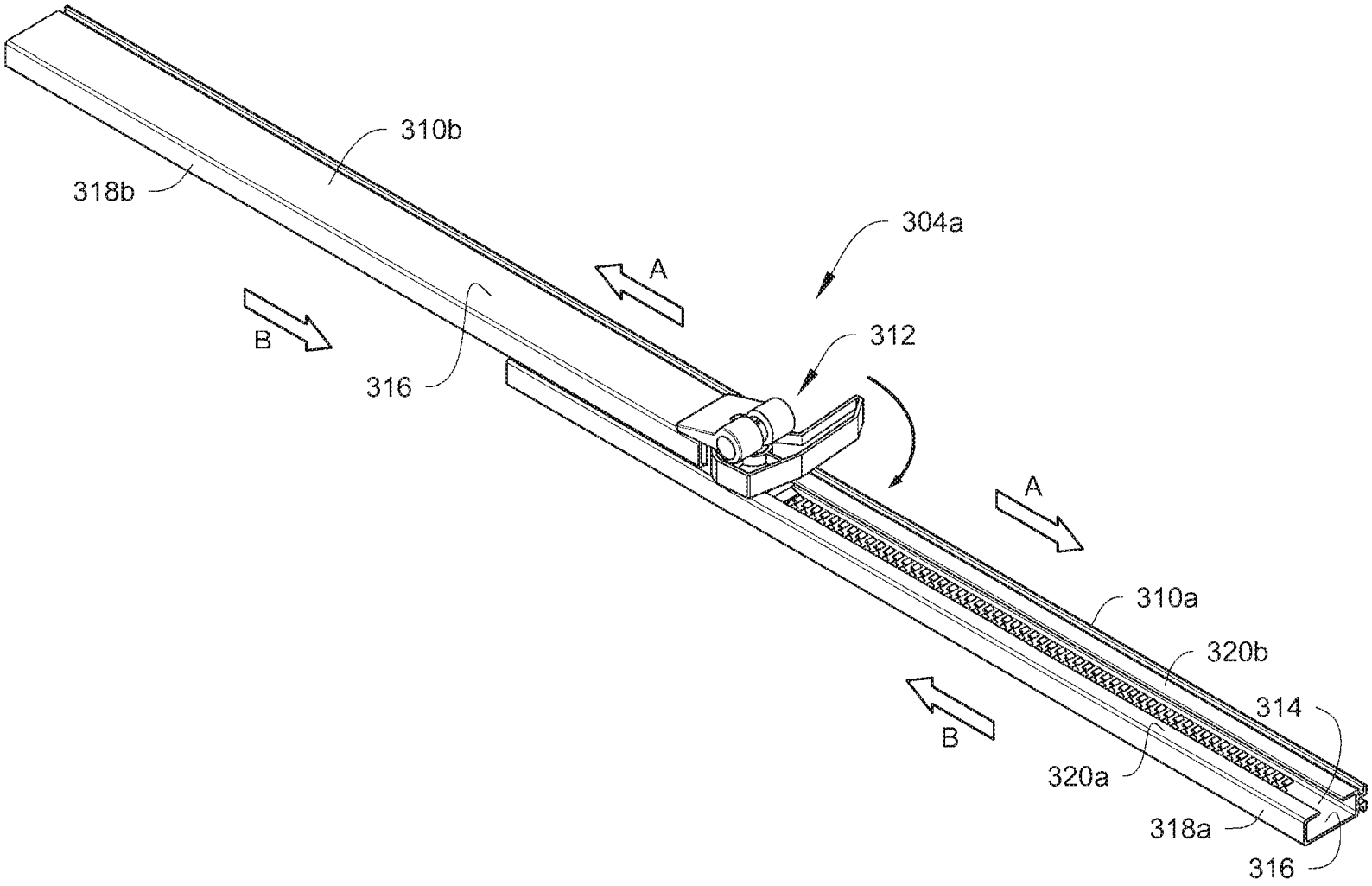

FIG. 17 is a detailed perspective view of one of the frame members of the blower door panel with a one-way self-locking length controller.

Figure 18:
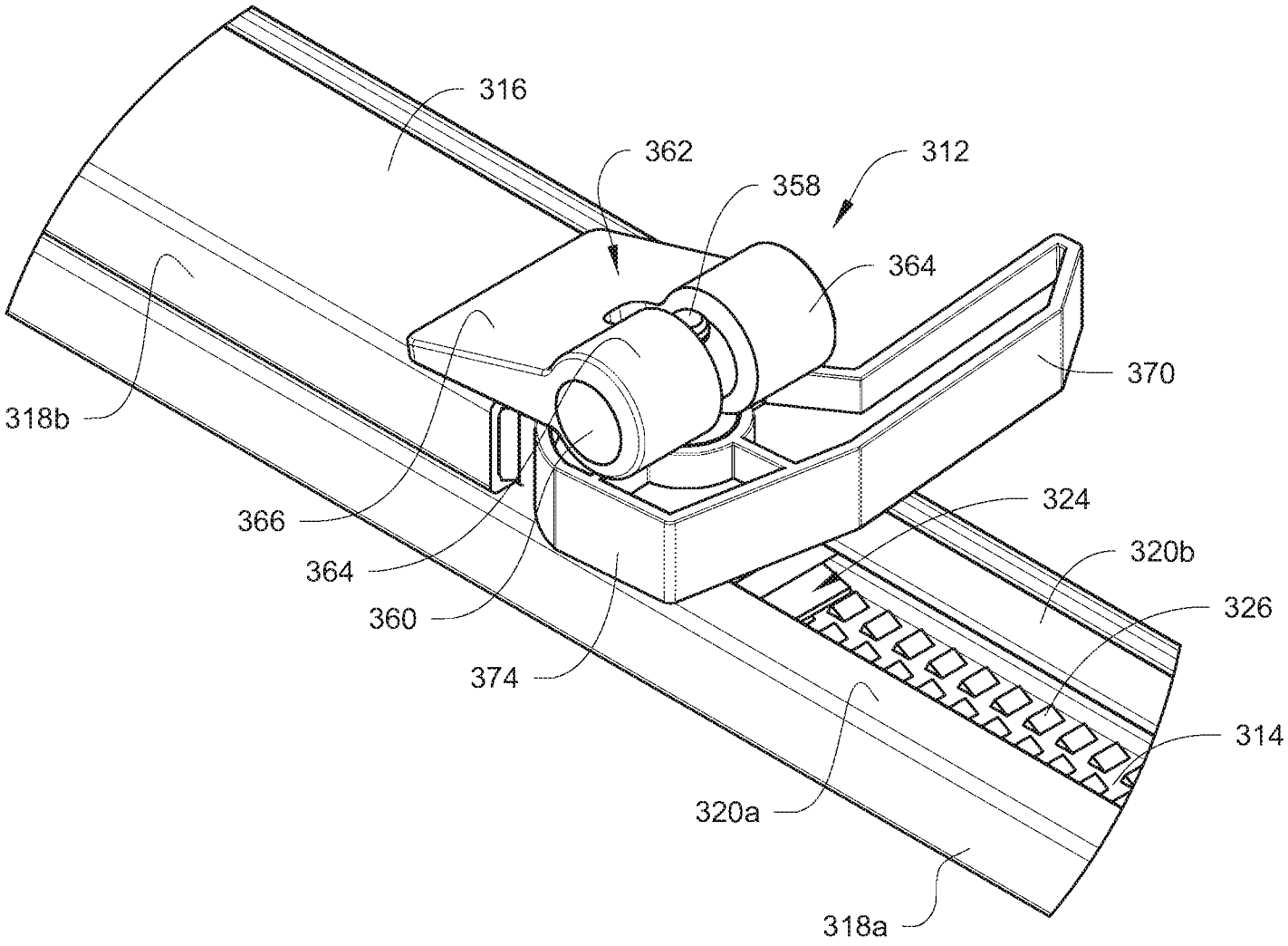

FIG. 18 is a close up view of the one-way self-locking length controller.

Figure 19:
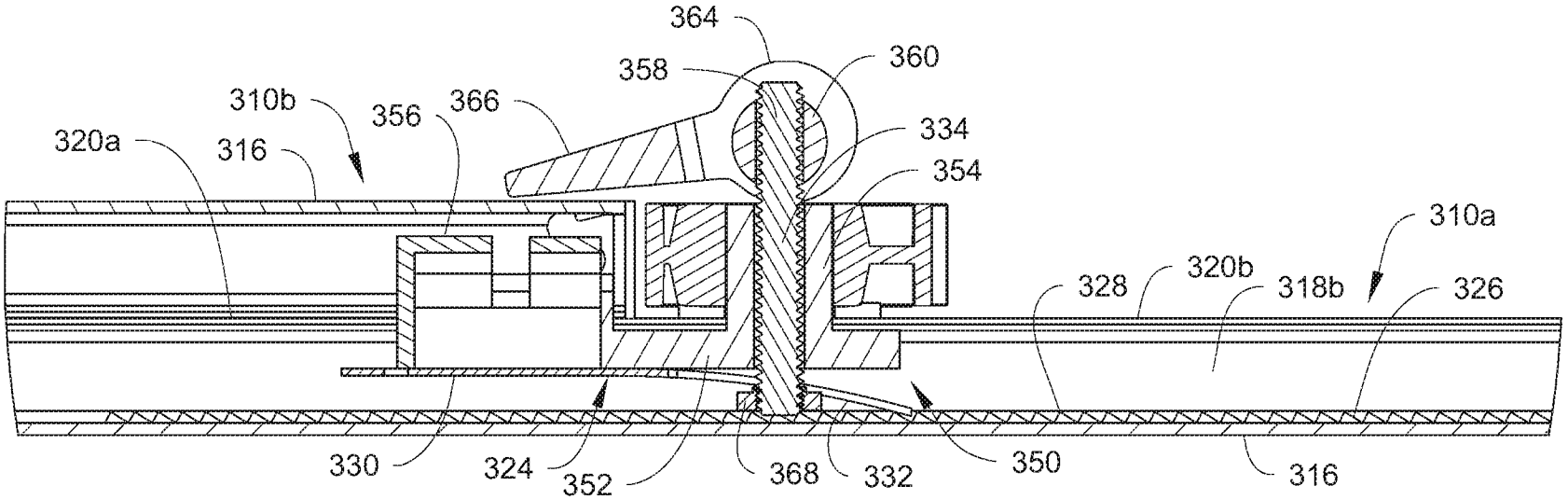

FIG. 19 is a cross-sectional view through the one-way self-locking length controller.

Figure 20:
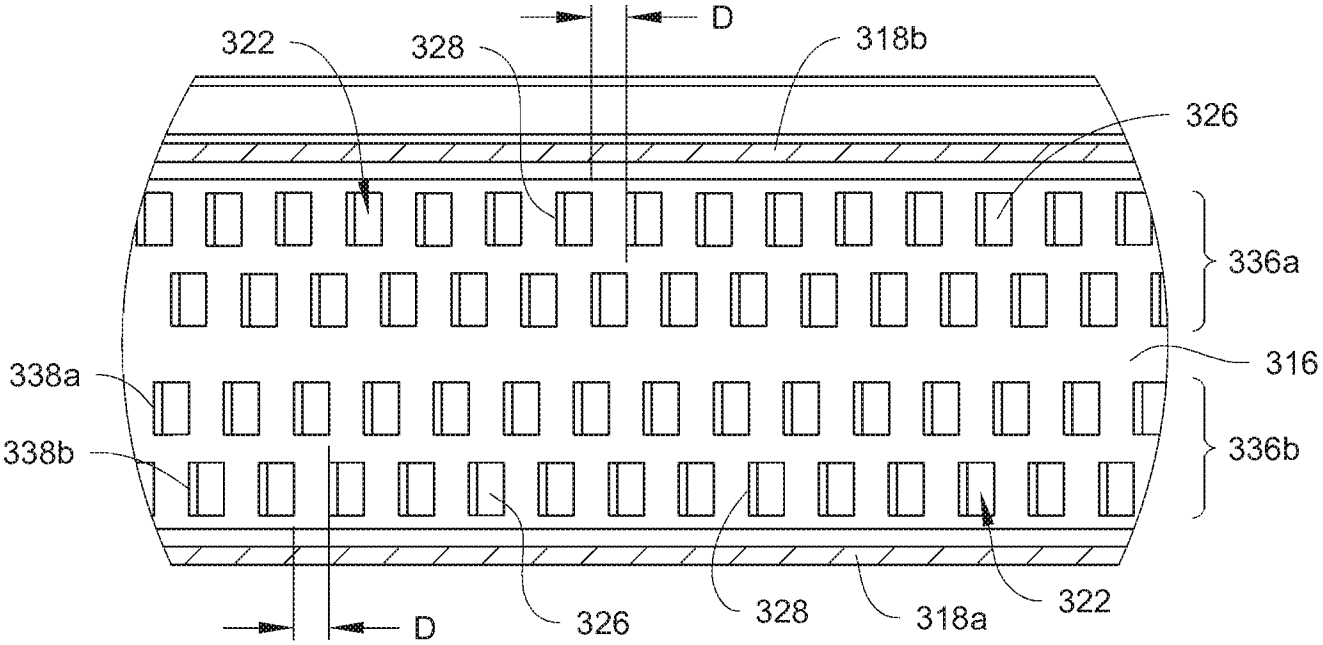

FIG. 20 illustrates details of a detent array within one of the frame portions of the one-way self-locking length controller.

Figure 21:
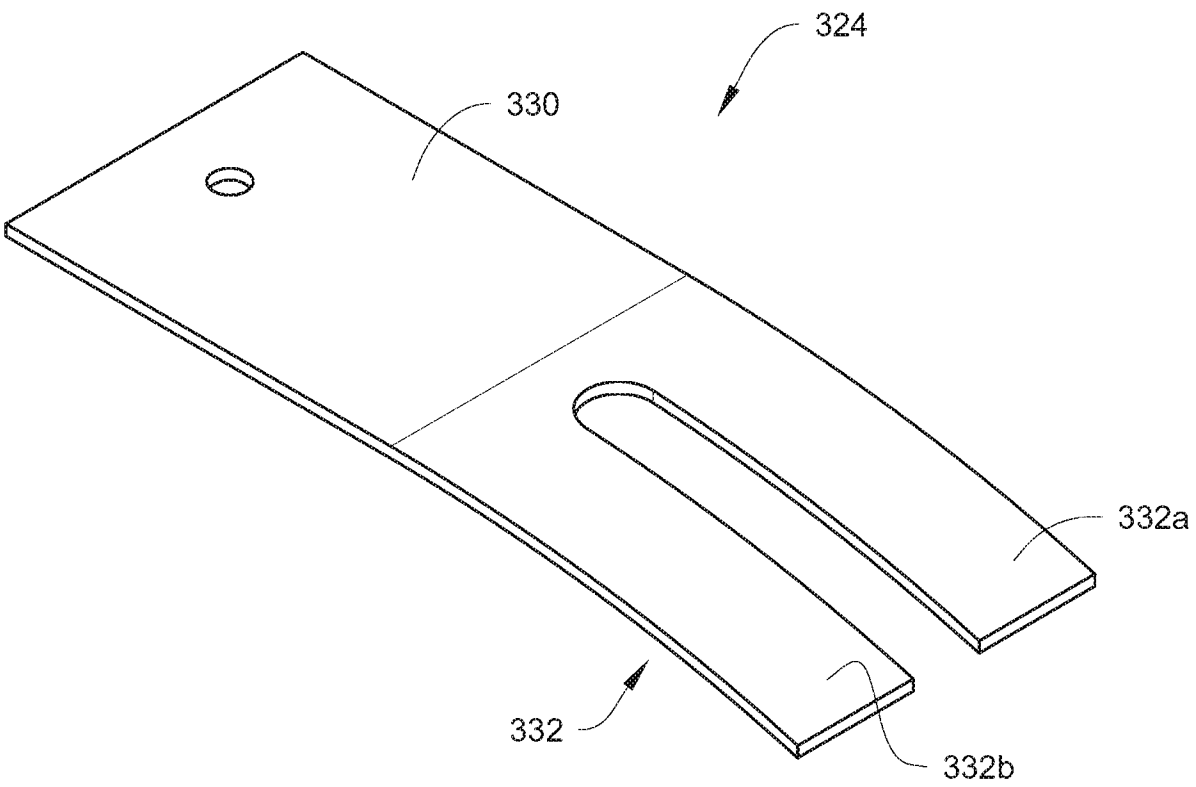

FIG. 21 is a perspective view of a leaf spring of the one-way self-locking length controller.

Figure 22:
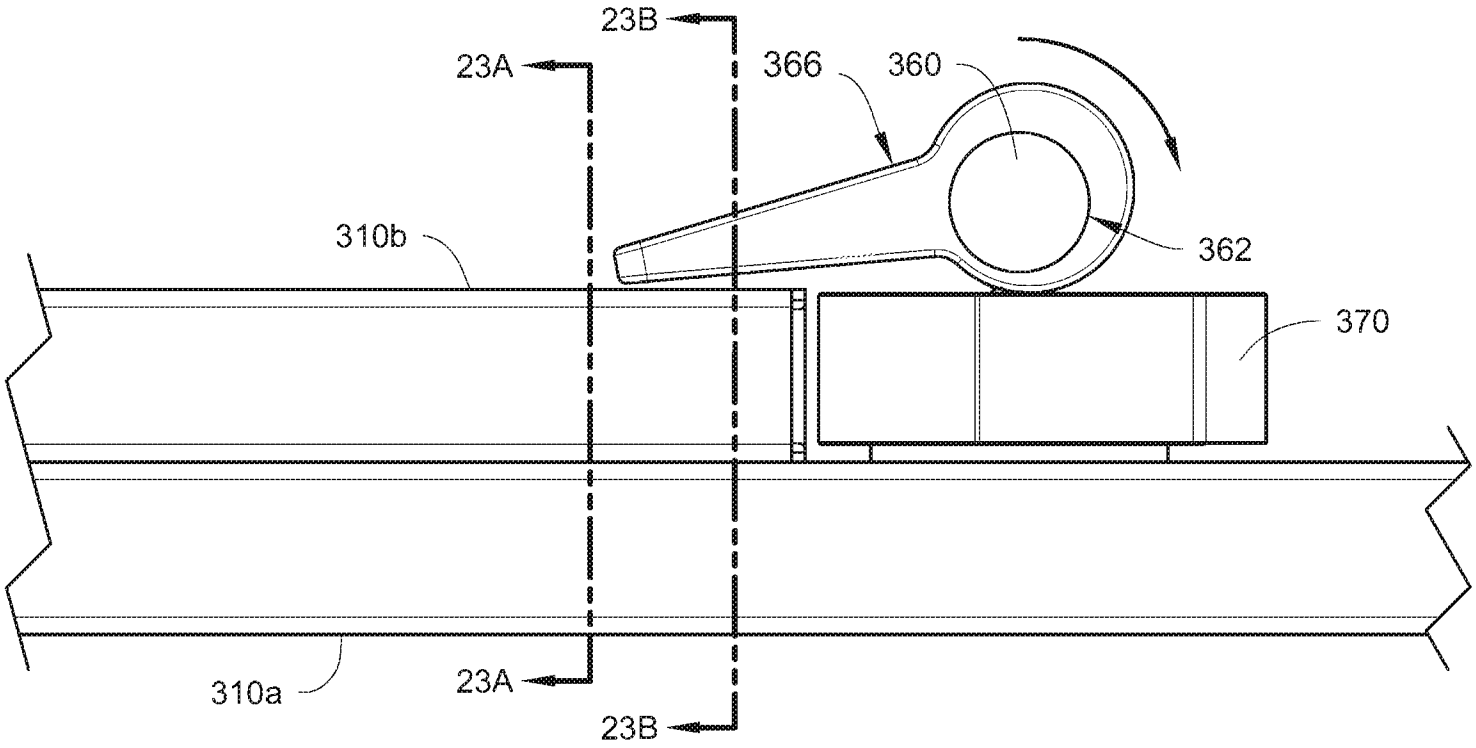

FIG. 22 is a side view of a portion of a frame member at the area including the one-way self-locking length controller.

Figure 23B:
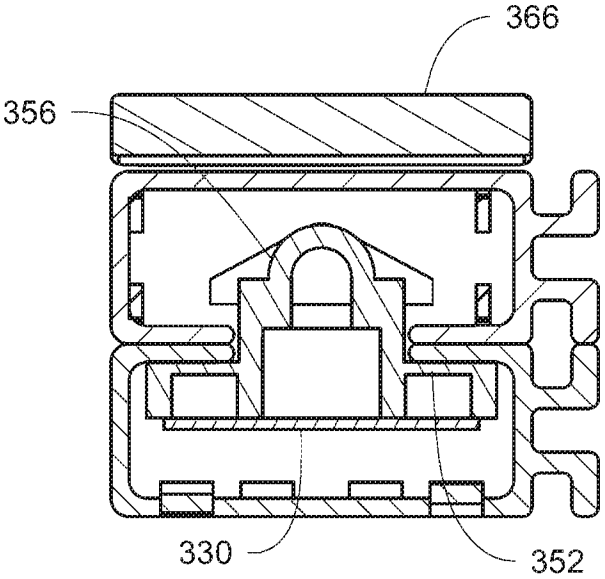
Figure 23A:
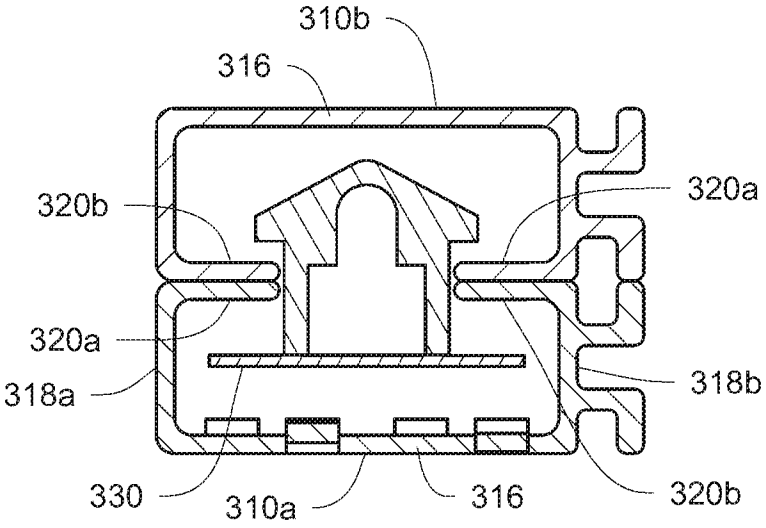

FIG. 23A is a cross-sectional view along line 23A-23A of FIG. 22.

FIG. 23B is a cross-sectional view along line 23B-23B of FIG. 22.

Figure 24:
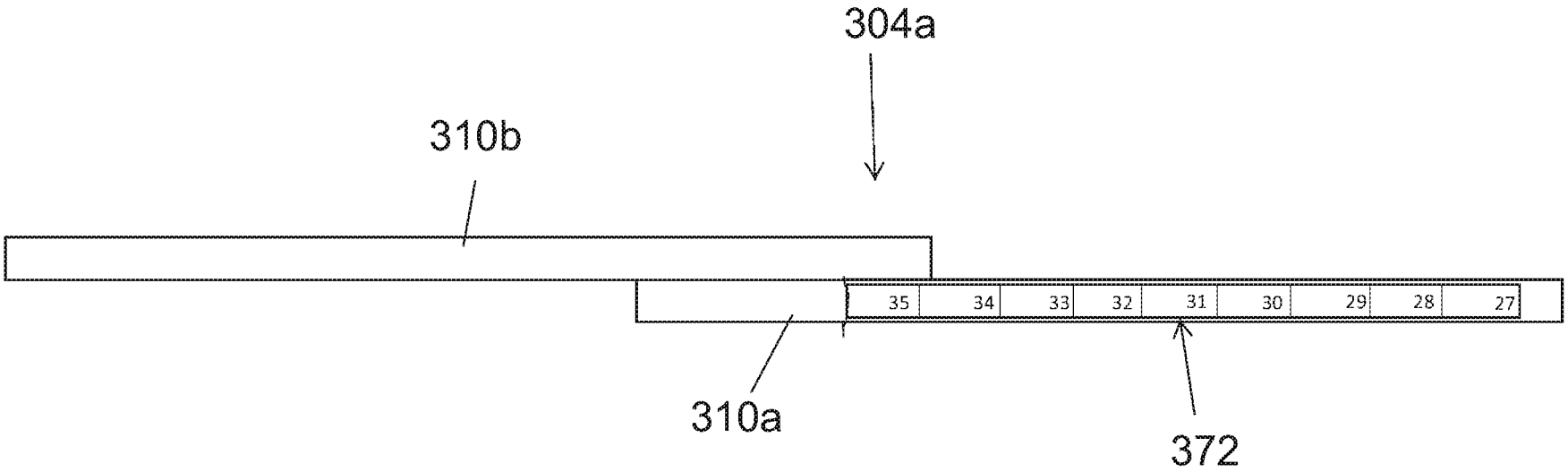

FIG. 24 illustrates an example of one of the frame members of the blower door panel of FIG. 16.

DETAILED DESCRIPTION

Figure 1:
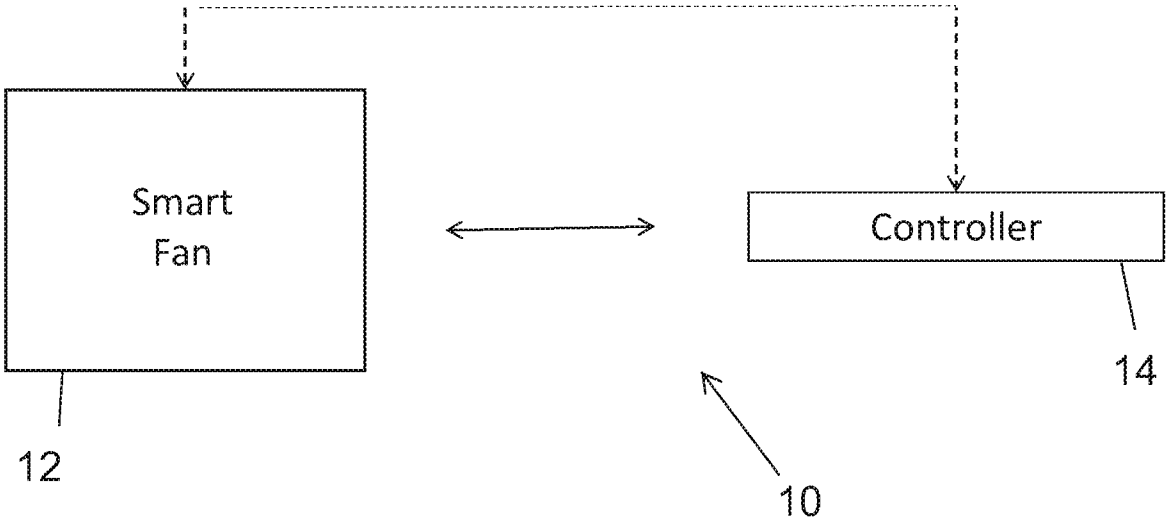
FIG. 1 is a schematic depiction of a system that includes the smart fan described herein in communication with a controller.

Referring to FIG. 1, a system 10 is depicted that includes a smart fan 12 that is in communication with a controller 14. The fan 12 can be in one-way or two-way wireless or wired communication with the controller 14. As described in further detail below, data regarding the fan 12 can be transmitted to the controller 14. In addition, data and/or control signals can be transmitted from the controller 14 to the fan 12. In the case of wireless communication, the communication can be made via any wireless communication technology including, but not limited to, WiFi, Bluetooth®, or other wireless communication technology.

The fan 12 can be used in any application in which a flow of a fluid, such as air, is required. For example, the fan 12 can be used to conduct a blower door test (described below with respect to FIGS. 12 and 14) and/or used to conduct a duct leakage test (described below with respect to FIG. 13). However, the fan 12 described herein can be used in other applications.

Figure 2:
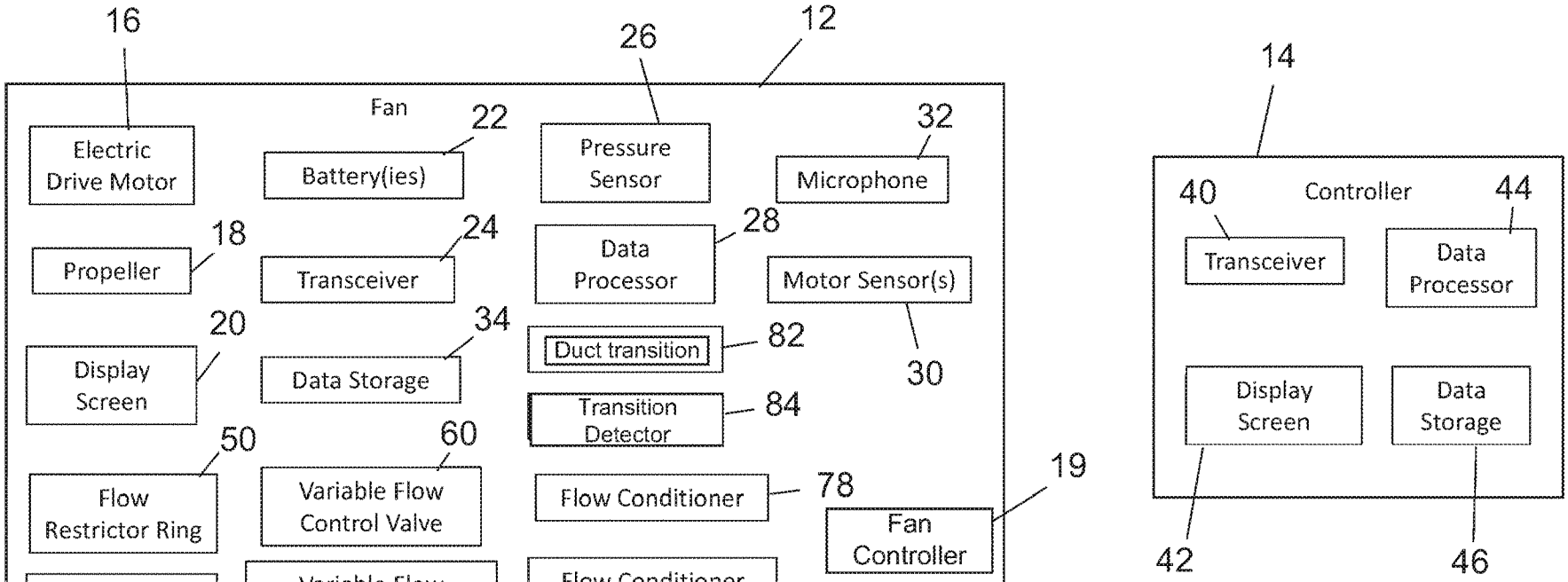
FIG. 2 is a schematic depiction of components of the smart fan and the controller.

The fan 12 and the controller 14 are schematically depicted in FIG. 2. The fan 12 includes an electric drive motor 16 which is in driving engagement with a propeller 18. For example, the propeller 18 can be mounted to an output shaft of the electric drive motor 16 to be driven by the electric drive motor 16 to generate flow through the fan 12. In one embodiment, the fan 12 and the propeller 18 can be configured for axial flow through the fan. In another embodiment, the fan 12 and the propeller 18 can be configured for centrifugal flow.

The fan 12 can also optionally include one or more of the following: a fan controller 19; a display screen 20; one or more batteries 22; a communications transceiver 24; a pressure sensor 26; one or more data processors 28; one or more motor sensors 30; a microphone 32; and data storage 34. These elements can be used in any combination on the fan 12.

The fan controller 19 controls operation of the fan 12 and its various electronic components such as the drive motor 16, the display screen 20, the various detectors and sensors, the transceiver 24, the data processor 28, etc.

The display screen 20 (if present) can display data regarding the fan 12 and its operation, display instructions to a user of the fan 12, and display other information. The display screen 20 may be a liquid crystal display or a light emitting diode display. The display screen 20 may be configured as a touchscreen to permit user inputs via the screen 20.

The battery(ies) 22 (if present) provide electrical power to the electric drive motor 16 and other components of the fan 12 requiring electrical power. The battery(ies) 22 may be removably mounted in or on the fan 12 to allow removal of the battery(ies) 22, for example to replace the battery(ies) 22 or to reduce the weight of the fan 12. The battery(ies) 22 may be rechargeable. The battery(ies) 22 may be configured as a removable battery pack permitting replacement with a replacement battery pack.

The communications transceiver 24 (if present) allows wireless communications between the fan 12 and one or more external devices, such as the controller 14. The transceiver 24 can be configured to permit any type of wireless communications including, but not limited to, WiFi, Bluetooth®, or other forms of wireless communication.

The pressure sensor 26 (if present) is positioned on the fan 12 to be able to detect the pressure of the flow through the fan 12. The pressure sensor 26 can directly detect the pressure or provide data from which the pressure can be calculated. The pressure sensor 26 may be removably mounted on the fan 12. The pressure sensor 26 can have any configuration that is suitable for detecting the pressure including, but not limited to, a pitot or other differential pressure sensor, or an anemometer. An example of the pressure sensor 26 is described below with respect to FIGS. 3-7.

The one or more data processors 28 (if present) processes data, executes computer instructions, and controls operation of the fan 12 including communications with the controller 14. The data processor(s) 28 can be, for example, a central processing unit or an application specific integrated circuit. The data processor(s) 28 can receive data from the electric drive motor 16, the motor sensor(s) 30, the transceiver 24, the pressure sensor 26, the microphone 32, and various detectors described further below.

The motor sensor(s) 30 (if present) sense one or more parameters of the motor 16. For example, the motor sensor(s) 30 can sense one or more of the motor current, the torque of the motor 16, and/or the speed of the motor 16. The parameter(s) detected by the motor sensor(s) 30 can be used, optionally together with the pressure detected by the pressure sensor 26, to help detect fan stall or excessive back pressure of the fan 12.

Figure 8:
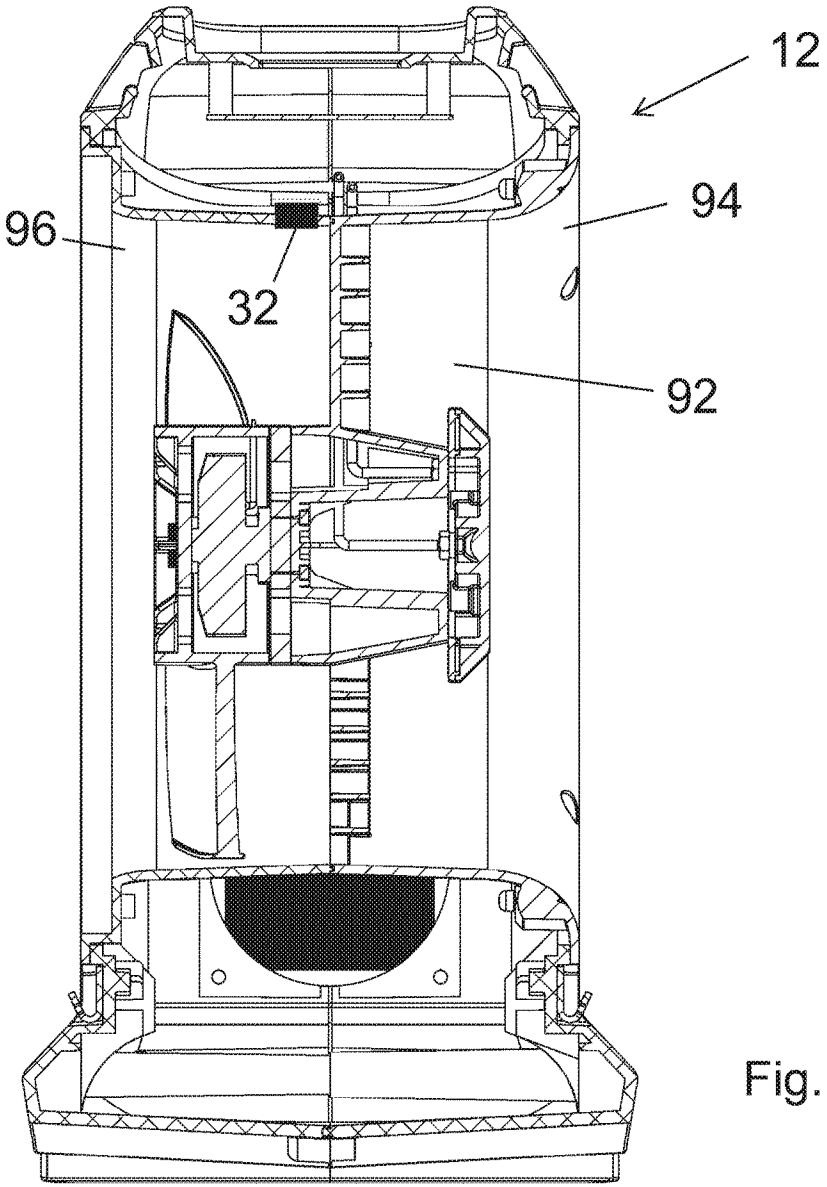
FIG. 8 depicts the use of an optional microphone on the fan.

The microphone(s) 32 (if present) is positioned in the fan 12 to detect the sound of the flow through the fan 12. The sound detected by the microphone(s) 32 can be used, optionally together with the pressure detected by the pressure sensor 26 and the output from the motor sensor(s) 30, to help detect fan stall of the fan 12. FIG. 8 depicts one example location of the microphone 32. However, other locations are possible.

The data storage 34 (if present) is a non-transitory computer-readable storage medium that is in electronic communication with the data processor(s) 28. The data storage 34 can store data collected by the various sensors and detectors of the fan 12, store data received from the controller 14, and store executable instructions or programs for operating the fan 12.

With continued reference to FIG. 2, the controller 14 can include a communications transceiver 40, a display screen 42, a data processor 44, and data storage 46. The communications transceiver 40 allows wireless communications with the fan 12. The transceiver 40 can be configured to permit any type of wireless communications including, but not limited to, WiFi, Bluetooth®, or other forms of wireless communication. The display screen 42 can display data regarding the fan 12 and its operation, display instructions to a user of the fan 12, and display other information. The display screen 42 may be a liquid crystal display or a light emitting diode display. The display screen 42 may be configured as a touchscreen to permit user inputs via the screen 42. The data processor 44 processes data, executes computer instructions, and controls operation of the controller 14 including communications with the fan 12. The data processor 44 can be a central processing unit or an application specific integrated circuit. The data processor 44 can receive data from the fan 12, or receive data input by a user. The data storage 46 is a non-transitory computer-readable storage medium that is in electronic communication with the data processor 44. The data storage 46 can store data received from the fan 12, entered into the controller 14, or generated by the data processor 44, and store executable instructions or programs for operating the controller 14. The controller 14 can be any device or group of devices that can interact with the fan 12 as described herein. For example, the controller 14 can be a mobile phone (including Android and iOS systems), a tablet, a laptop computer, or a specifically configured computing device such as a specifically configured tablet or mobile phone.

Figure 3:
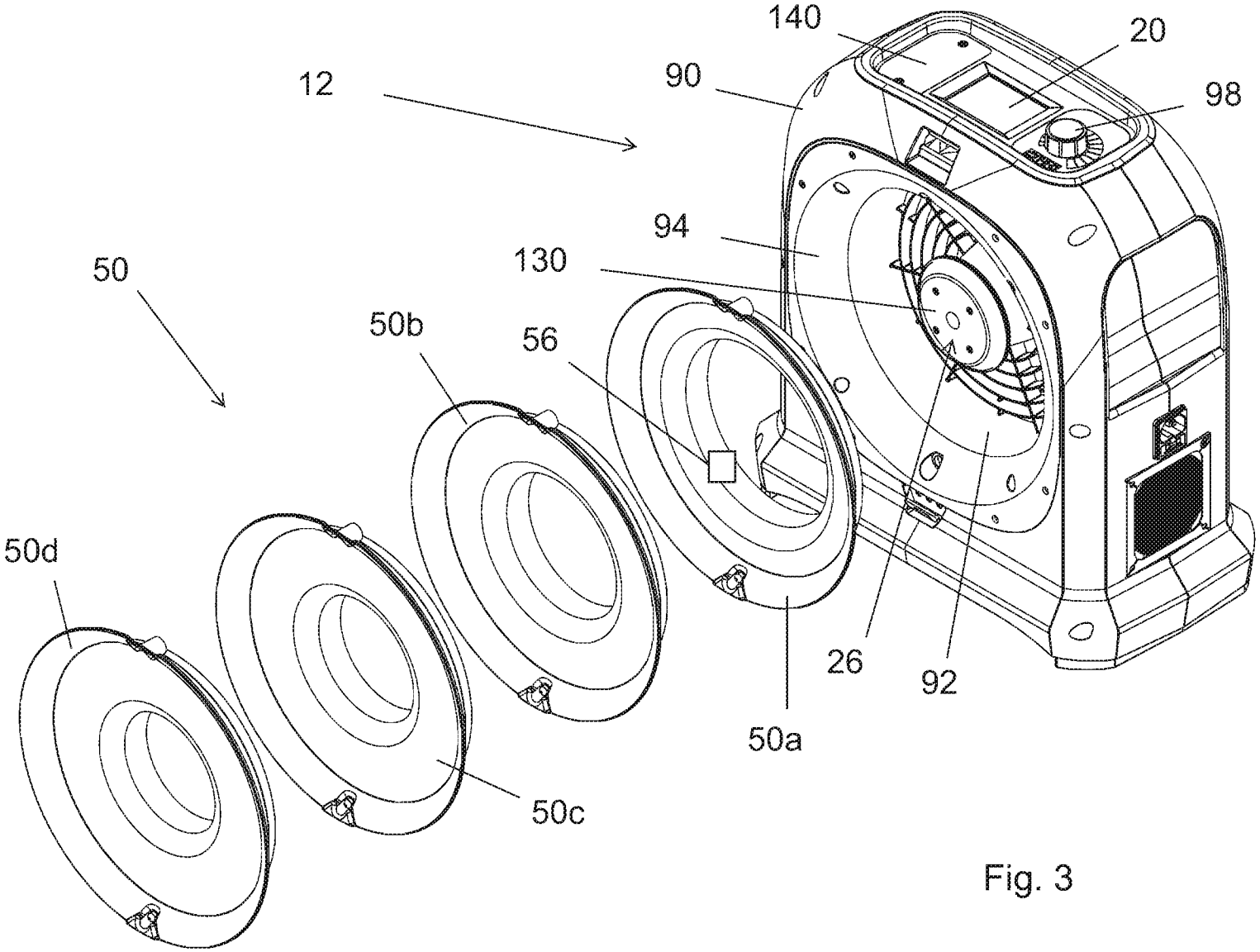
FIG. 3 is a perspective view of the smart fan and flow restrictor rings that can be removably installed on the smart fan.
Figure 4:
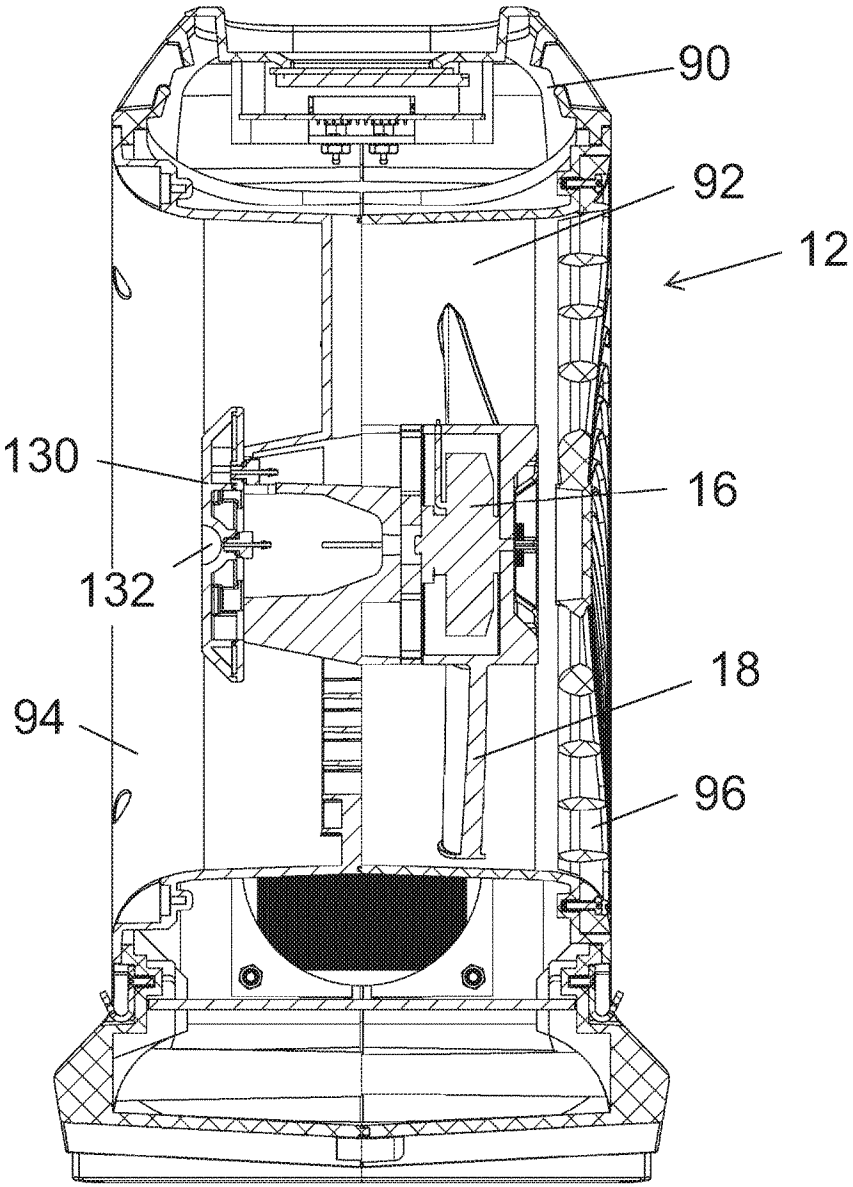
FIG. 4 is a cross-sectional view of the smart fan.

Referring to FIGS. 3 and 4, the fan 12 can include a fan housing 90 that houses some of the components of the fan and that defines a flow passage 92 through the fan 12 from an inlet side 94 to an outlet side 96. The fan 12 may also include a manual speed control 98, such as a rotatable knob or other control device, that allows manual control of the speed of the fan 12, for example by rotating the knob 98 or other control device.

With reference to FIGS. 2-3, 9A, and 11A-11B, the fan 12 can include one or more flow restrictors that can be used to alter the flow through the fan 12. The flow restrictor can be permanently mounted on the fan 12 or removably mounted on the fan 12. The flow restrictor can be positioned upstream or downstream of the propeller 18, be positioned closer to the fan inlet than to the fan outlet, or positioned closer to the fan outlet than to the fan inlet. The flow restrictor is variable in that the flow restrictor can be changed or modified to change the flow parameters through the fan 12. The flow restrictor can have any form or construction, and location on the fan 12, for performing the functions of the flow restrictors described herein.

Figure 9C:
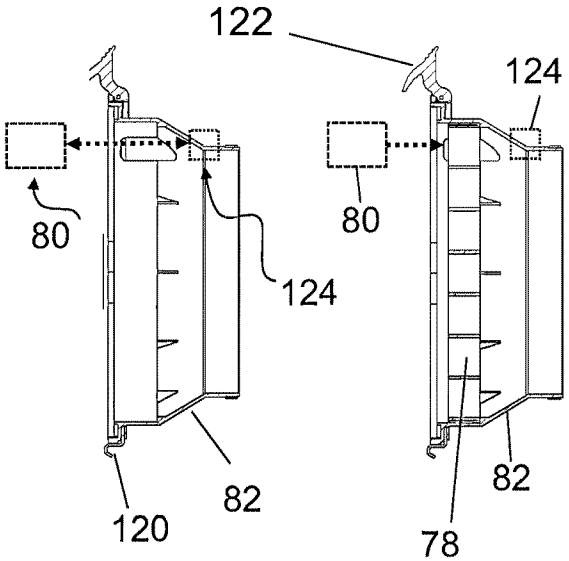
FIG. 9C illustrates an example of a flow conditioner detection that can be used on the fan.
Figure 9A:
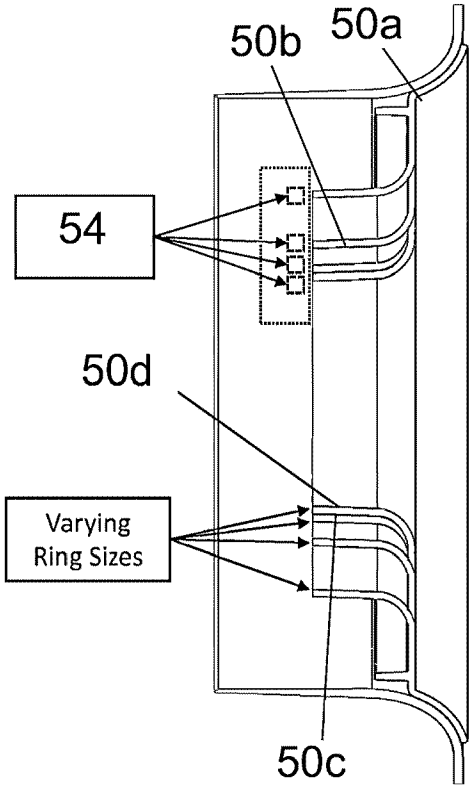
FIG. 9A illustrates an example of ring detection that can be used on the fan.

For example, referring to FIGS. 2-3 and 9A, in one embodiment the flow restrictor can comprise a removable flow restrictor ring 50. The ring 50 can be one of a plurality of flow restrictor rings 50*a*, 50*b*, 50*c*, 50*d* (visible in FIGS. 3 and 9A) that have different diameters and each of which is removably mountable on the fan 12, for example in the inlet of the fan 12. When mounted on the fan 12, the ring 50 reduces the area of the flow passage thereby changing the flow through the fan 12.

Each ring 50*a-d* may be secured on the fan 12 and to one another via an interference or friction fit, using magnets, using one or more mechanical fasteners such as screws, or secured to the fan 12 using any other removable connection mechanism. FIG. 9A depicts the flow restrictor rings 50*a*-50*d* mounted on the fan 12 and secured in position. Each ring 50*a-d* may be individually and separately removably mounted on the fan 12. Alternatively, as depicted in FIG. 9A, the rings 50*a-d* may be sized to nest within one another whereby the largest diameter ring 50*a* can be removably mounted to the fan 12, the ring 50*b* can nest within and be removably secured to the ring 50*a*, and the ring 50*c* can nest within and be removably secured to the ring 50*b*, etc.

With continued reference to FIG. 9A, one or more ring detectors 54 can be provided on the fan 12 that is positioned to detect the presence of the ring(s) 50*a-d*. Any mechanism(s) that can detect the presence of the ring(s) 50*a-d* can be used. For example, the ring detector(s) 54 can be a photosensor(s) that detect an edge of the ring(s) 50*a-d*, a mechanical switch(es) that is engaged by an edge of the ring(s) 50*a-d*, or an RFID tag 56 (seen in FIG. 3) on the ring(s) 50*a-d* that is sensed by a suitable reader on the fan 12.

FIGS. 2, and 11A-B depict another form of a flow restrictor in the form of a variable flow control valve 60. The control valve 60 controls the amount of flow through the fan 12 by restricting the size of the flow passage through the fan 12. The control valve 60 can be used instead of the rings 50*a-c*, or together with one or more of the rings 50*a-c*.

FIGS. 11A-B depict the control valve 60 as an iris valve. However, other forms of variable flow control valves, such as a gate valve or a poppet valve, can be used. The iris valve includes a plurality of shutters 64 that can be actuated by an actuator 66 to adjust the positions of the shutters 64 (see FIG. 11B) and thereby control the diameter of the flow passage 68 through the iris valve. The general construction and function of iris valves is well known in the art.

If used on the fan 12, the variable flow control valve may be operated manually or by the addition of a motor driven adjustment mechanism with an adjustment motor such that the valve can be adjusted automatically to achieve the desired combination of air flow, back pressure, and sensor signal. In one embodiment, the variable flow control valve can be adjusted automatically based on a timed control scheme where adjustments occur at set times during a test routine. Adjustments may be controlled by a software algorithm running remotely, for example on the controller 14 in FIG. 1, or locally by the fan controller 19 within the fan's electronics.

A motorized variable flow control valve may also be operated such that the flow path of the fan may be closed off entirely. Completely closing the flow path of a fan is well known in the art of testing buildings and ducts since it is used to measure the baseline pressure of a building or other volume before the fan has begun to pressurize or depressurize the volume.

Referring to FIG. 2, regardless of the form of the variable flow control valve 60 that is used, a detector 76 can be provided to detect the position of the valve 60 and thereby determine the corresponding flow through the fan 12. The detector 76 can have any form that is suitable to detect the positions of the valve 60. For example, the detector 76 can be a position detector sensor such as an ultrasonic sensor, a photoelectric sensor, a magnetic sensor, and the like.

Figure 9B:
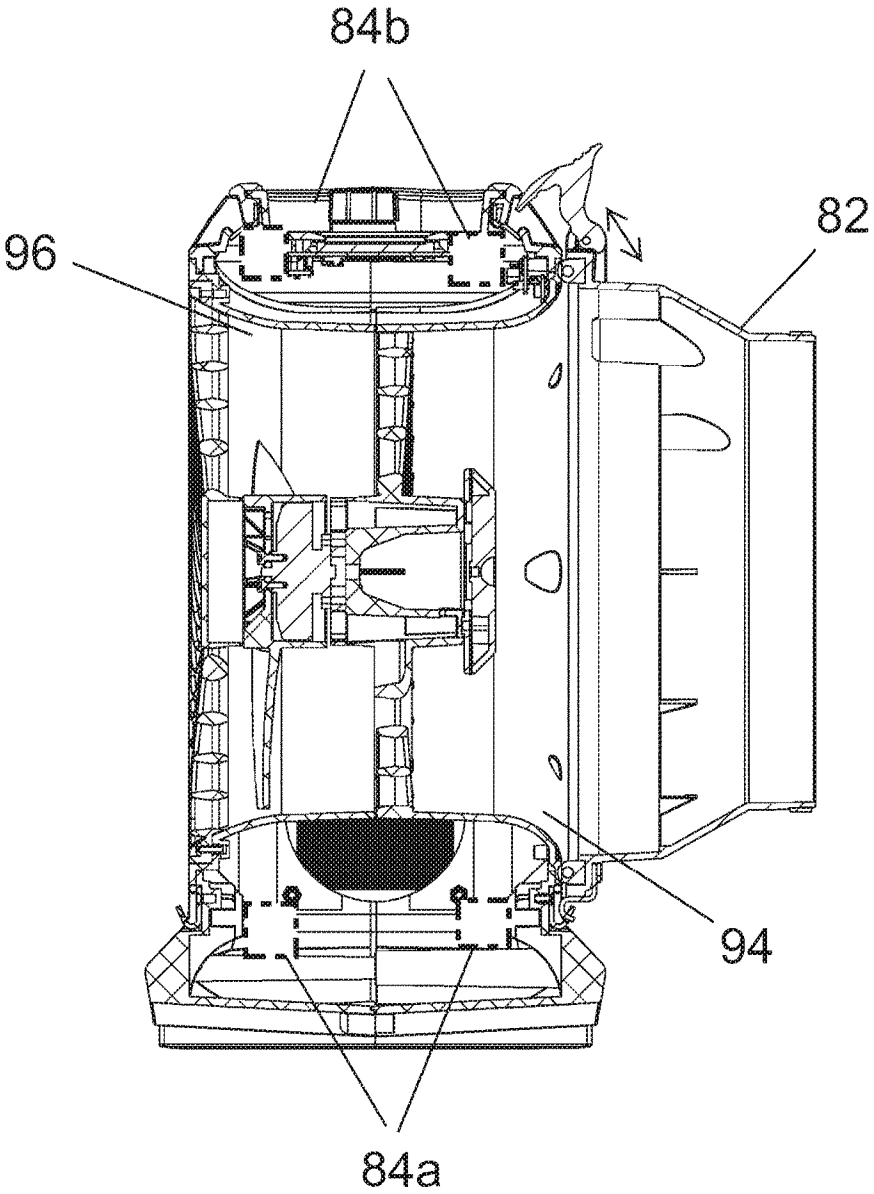
FIG. 9B illustrates an example of a transition detection that can be used on the fan.

Referring to FIGS. 2 and 9B, in an embodiment a duct transition 82, which may be flexible, can be connected to the outlet 96 or the inlet 94 (as shown in FIG. 9B) of the fan 12. The duct transition 82 can be used for any purpose. For example, in an embodiment, the duct transition 82 includes a flexible duct that can be used to conduct a duct leakage test on an HVAC system of a building as described further below with respect to FIG. 13. When used for a duct leakage test, the duct transition 82 fluidly connects the outlet of the fan 12 and the HVAC system (seen in FIG. 13) in a fluid-tight manner so that the output flow from the fan 12 is directed into the HVAC system with little or no loss of fluid to test for leakages in the ducts of the HVAC system. A duct transition detector 84 can be provided on the fan 12, for example at the outlet and/or at the inlet that is positioned to detect the presence and optionally the size of the duct transition 82. Any mechanism(s) that can detect the duct transition 82 can be used. For example, referring to FIG. 9B, the detector 84 is depicted as including hall effect sensors 84*a* at both the inlet 94 and the outlet 96 that can detect a portion of the duct transition 82, for example a hook 120 (seen in FIG. 9C) on the duct transition, and hall effect sensors 84*b* at both the inlet 94 and the outlet 96 that detects another portion of the duct transition 82, for example a latch 122 having one or more magnetic elements on the duct transition 82 that is used to latch the duct transition 82 to the inlet or to the outlet. Alternatively, the detector 84 can be a photosensor(s), a mechanical switch(es), an RFID tag on the duct transition 82 that is sensed by a suitable reader on the fan 12, or any other detector.

With reference to FIGS. 2 and 9C, in one embodiment a flow conditioner 78 can be provided on the fan 12 to condition the flow, for example by eliminating swirl, turbulence, etc. and create a consistent velocity profile across the flow passage. The flow conditioner 78 can have any form suitable for conditioning the flow. For example, FIG. 9C illustrates the flow conditioner 78 as a flow conditioning plate having a plurality of holes through the plate. The flow conditioner 78 can be located upstream of the propeller 18. In the embodiment illustrated in FIG. 9C, the flow conditioner 78 is located at the inlet of the fan 12 in the duct transition 82. In an embodiment, when the duct transition 82 is mounted at the outlet, the flow conditioner 78 may be removed. A flow conditioner detector 80 can be provided on the fan 12 that is positioned to detect the presence and the type of the flow conditioner 78. Any mechanism(s) that can detect the presence of the flow conditioner 78 can be used. For example, referring to FIG. 9C, the flow conditioner detector 80 can comprise a photodetector that emits light toward a reflective target 124. When the flow conditioner 78 is not present (left side of FIG. 9C), the light from the photodetector reflects back to the photodetector from the target 124. When the flow conditioner 78 is present (right of FIG. 9C), the flow conditioner interrupts the light beam and no light is reflected back to the photodetector by the target 124 indicating the presence of the flow conditioner 78. Alternatively, the detector 80 can be a mechanical switch(es), an RFID tag on the flow conditioner 78 that is sensed by a suitable reader on the fan 12, or any other detector.

Figure 5A:
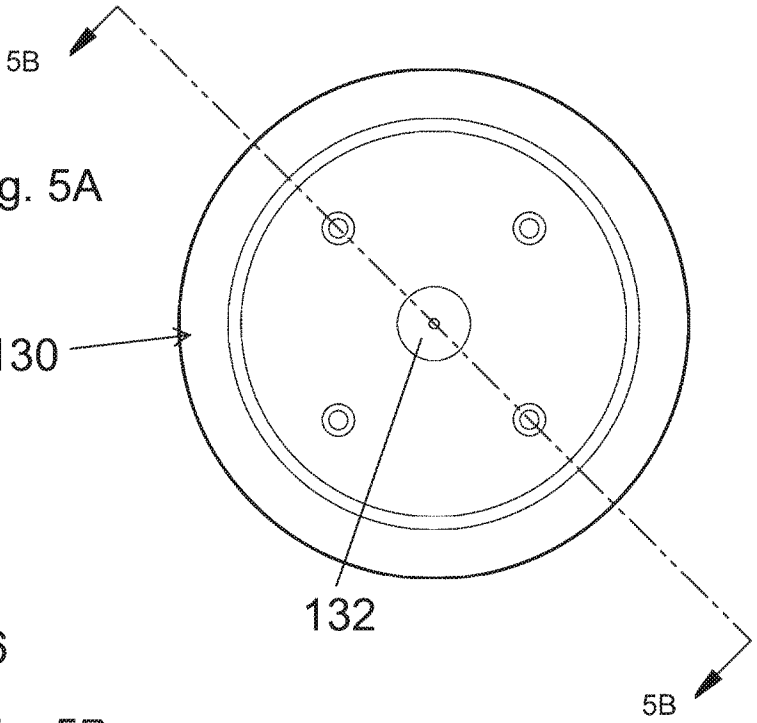
FIG. 5A is an end view of the truncated cone pressure sensor.
Figure 5B:
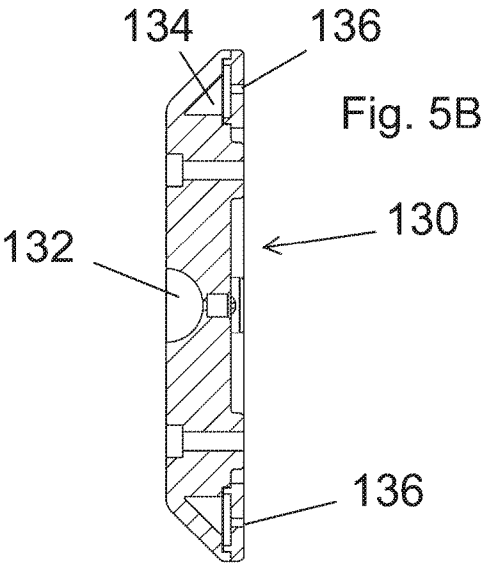
FIG. 5B is a cross-sectional view taken along line 5B-5B of FIG. 5A.
Figure 6:
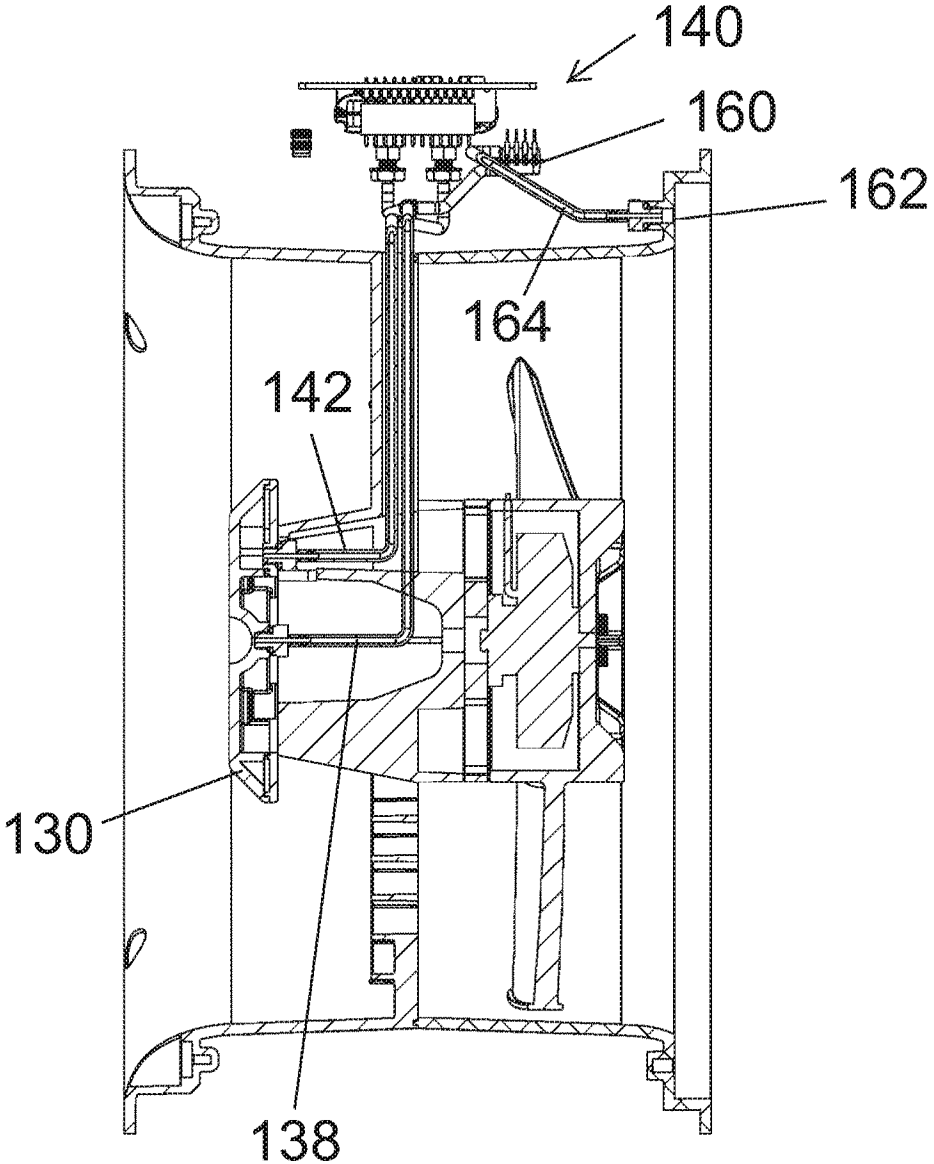
FIG. 6 illustrates connection between the truncated cone pressure sensor and the sensor assembly.

Referring to FIGS. 3-6, the fan 12 can include the pressure sensor 26 to detect the pressure of the flow through the fan 12. In one embodiment, the pressure sensor 26 is depicted as being located at the central axis of the fan 12. As best seen in FIGS. 4-6, the pressure sensor 26 includes a sensing plate 130 that is shaped as a truncated cone. The truncated cone shape is useful in reducing the effect of asymmetrical air velocity entering the sensor 26 as well as the influence of the fan's back pressure on its measurement of air flow.

As best seen in FIGS. 5A-5B, the sensing plate 130 includes a total pressure port 132 on the front face thereto which may be located on the central axis of the fan. The port 132 can have a circular, concave cup shape. The plate 130 further includes a circumferential suction pressure plenum 134 that communicates with a plurality of suction pressure ports 136 on the rear face of the plate 130. In one embodiment, there can be four of the suction pressure ports 136 that are circumferentially evenly distributed from one another on the rear face. The detected total pressure and the detected suction pressure are used to calculate the flow through the fan. The locations of the ports 132, 136 minimizes measurement errors due to backpressure.

Figure 7A:
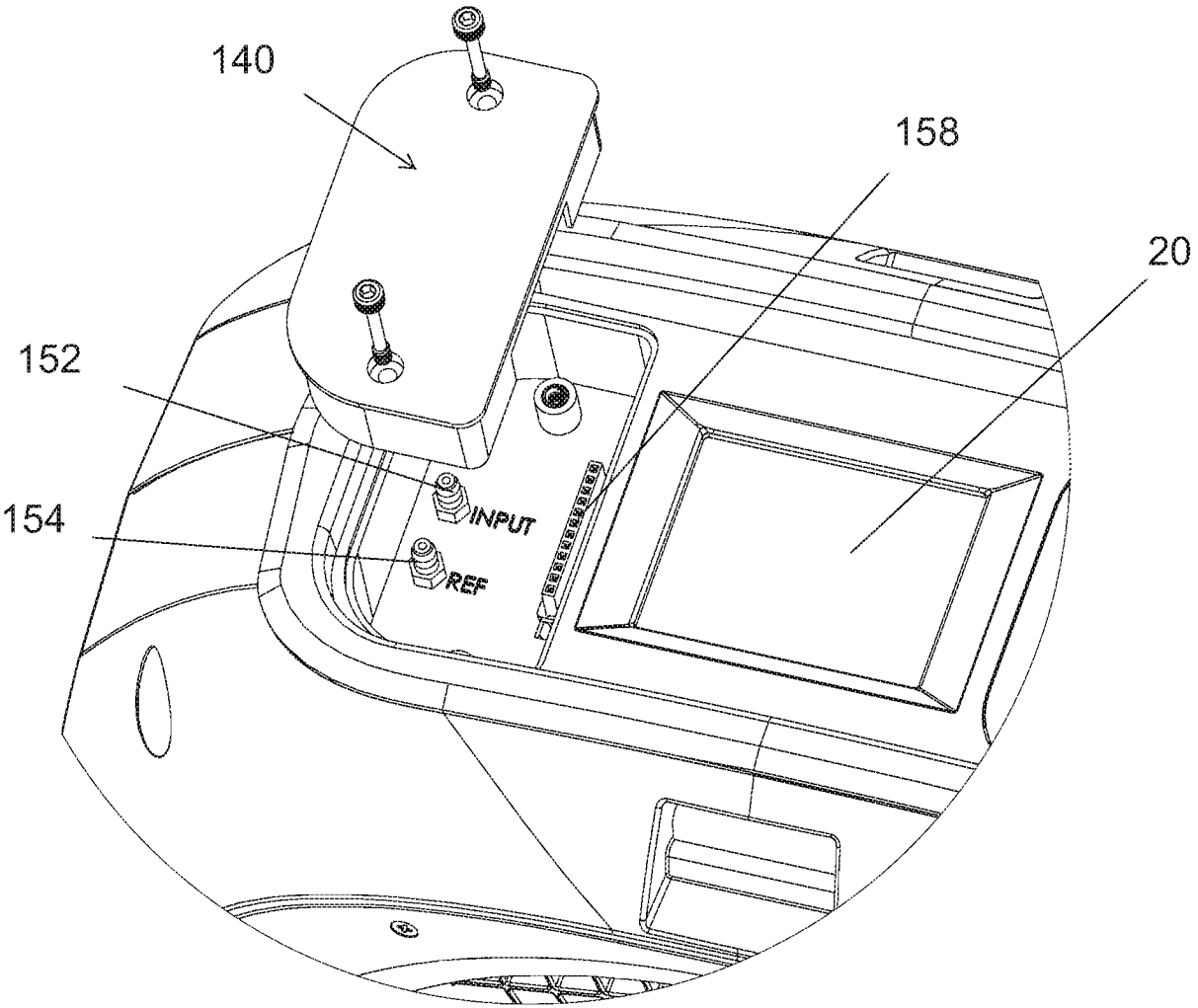
FIG. 7A illustrates a portion of a removable sensor assembly.
Figure 7B:
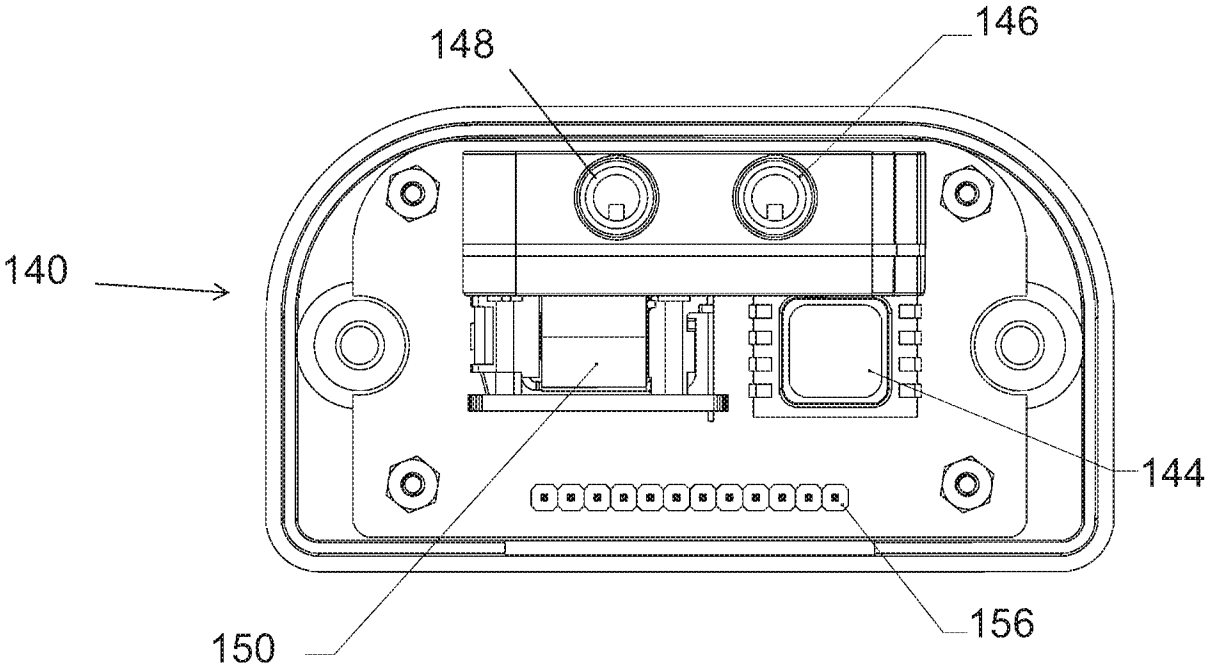
FIG. 7B is a top view of the removable portion of the sensor assembly with the top removed to show interior components.

Referring to FIG. 6, a total pressure line 138 fluidly connects to the total pressure port 132 and extends to a sensing assembly 140 located on the fan to communicate the total pressure to the sensing assembly 140. In addition, a suction pressure line 142 fluidly connects to the suction pressure plenum 134 and extends to the sensing assembly 140 to communicate the suction pressure to the sensing assembly 140. The total pressure line 138 and the suction pressure line 142 connect to a first pressure sensor 144 of the sensing assembly 140. For example, referring to FIGS. 7A and 7B, the sensing assembly 140 can include a port 146 that fluidly connects to the total pressure line 138 via a port 152 (FIG. 7A) and a port 148 that fluidly connects to the suction pressure line 142 via a port 154 (FIG. 7A). The ports 146, 148 fluidly communicate with the pressure sensor 144 to measure pressure. A solenoid valve 150 can be provided to selectively control the flow from the ports 146, 148 to the pressure sensor 144. The sensing assembly 140 can also include an electrical connector 156, for example a pin connector, that electrically connects the sensing assembly 140 to an electrical connector 158. The sensing assembly 140 is depicted as being removable from the fan. This permits the sensing assembly 140 to be replaced, for example as part of maintenance on the fan, or allow a different sensing assembly 140 with different sensing functions to be installed on the fan.

FIG. 6 illustrates an embodiment where a second pressure sensor 160 is provided as part of the sensing assembly 140. The second pressure sensor 160 is in fluid communication with the total pressure line 138. In addition, one or more fan outlet pressure ports 162 are provided and are fluidly communicated with the pressure sensor 160 via an outlet pressure line 164. The second pressure sensor 160 measures the difference between the total pressure measured by the port 132 and the outlet pressure measured by the port 162. This difference can be used to detect operating conditions of the fan, such as stall, due to high backpres sure. This difference may also be used for test configuration diagnostics to improve measurement integrity.

FIG. 10 illustrates how pressure sensor 26 data and outputs from the motor controller 19 can be used to determine operating conditions of the fan 12. Outputs from the motor controller 19 can include, but are not limited to, current command settings, actual speed of the fan, and motor power. The motor controller outputs and the pressure sensor data can be provided to the controller 14 and used to detect stall of the fan or other operating conditions of the fan that are outside of the design or expected conditions.

The fan 12 can be used in any desired application. One example application is illustrated in FIG. 12. In this example, the fan 12 can be used to conduct a blower door test to measure the airtightness of a building 100. When conducting a blower door test, the fan 12 is mounted on a blower door panel 102 which is secured to and seals with the door or window in which it is mounted. The general construction of blower door panels for conducting blower door tests, and the overall process of conducting blower door tests, is well known in the art.

FIG. 14 illustrates another example of the use of the fan 12, in this case using two or more of the fans 12 set-up to conduct a blower door test. In this example, two or more of the fans 12, for example three of the fans 12, are mounted on the blower door panel 102. In this example, the fans 12 are powered by a common power source that is separate from the fans 12. The configuration in FIG. 14 permits a blower test to be conducted using multiple fans that are powered by a single common power source. In this example, the battery 22 may or may not be removed from each of the fans 12. However, it is preferred that the batteries are not present which reduces the weight of the fans 12 and facilitates vertical stacking of the fans 12.

The common power source can be any power source that is able to simultaneously power all of the fans 12. For example, the common power source can be a wall outlet 104, one or more batteries 106, or a generator 108. A power management system 110 is connected to each power source 104, 106, 108 and controls which source provides electrical power to the fans 12, as well as suitably conditions the electrical power provided to the fans 12. For example, the power management system 110 can eliminate voltage spikes or dips that may adversely affect the function of the fans 12. The power management system 110 also controls charging of the batteries 106 for example using power from the wall outlet 104. The wall outlet 104 can provide alternating current (AC), for example 110 V or 220 V, which is converted to direct current (DC) by the AC/DC converter 110 which is well known in the art. The generator 108 can provide DC power or AC power. If the generator 108 provides AC power, an AC/DC converter is provided to convert the AC power to DC power.

FIG. 13 illustrates another example of the use of the fan 12, in this case using the fan 12 to conduct a duct leakage test. A duct leakage test is conducted to measure the air tightness of HVAC ductwork. In this example, the outlet of the fan 12 is connected in a fluid tight manner to one end of a duct or conduit 114 and the other end of the duct/conduit 114 is connected in a fluid tight manner to an HVAC system 116. The general concept of duct leakage testing and how to conduct such testing is well known in the art.

The fan 12 described herein provides a number of advantages. For example, referring to FIG. 1, in general the fan 12 can be used to conduct a blower door test or a duct leakage test under control by the controller 14. Other advantages include, but are not limited to, the following:

- The speed of the fan 12 can be wirelessly controlled by the controller 14.
- The fan 12 can send fan identification information to the controller 14 so that the controller 14 knows specific performance parameters of the fan 12 that may be unique to the fan 12.
- Stalling of the fan or excessive back pressure can be detected, for example by data provided by the pressure sensor 160, the motor sensor(s) 30, and/or the microphone 32, with the data being communicated to the controller 14 which uses the data to determine the stall or excessive back pressure condition. Alternatively, the data processor 28 on the fan 12 can use the data from one or more of the pressure sensor 160, the motor sensor(s) 30, and/or the microphone 32, to determine the stall or excessive back pressure condition, and send a suitable signal to the controller 14.
- The fan 12 can detect whether a flow restrictor, such as one of the rings 50*a-c*, is in position on the fan 12, as well as detect the type (in the case of the rings 50*a-c*) or position (in the case of the variable flow control valve 60) of the flow restrictor. This permits a determination of the measured flow through the fan 12, which can be communicated to the controller 14.
- The fan 12 can also detect the presence and optionally the type of additional components such as the flow conditioner 78 or the duct transition 82. This data can also be communicated to the controller 14.
- Test set-up data, for example set-up data for conducting a blower door test or a duct leakage test, can be stored on the fan 12 and/or on the controller 14. The set-up data can include information on the type and/or position of flow restrictor to be used during a test, the type of flow conditioner that should be used, the desired speed of the fan, the most recent calibration date, the GPS location of the fan 12, the date of the test, identification of the operator conducting the test, and other data.
- A plurality of the fans 12 can be used together and powered simultaneously from a single common power source to conduct a blower door test. This is beneficial when multiple power outlets are not available or conveniently located, and when the maximum power draw of the fans 12 exceeds the power that is available from a single wall outlet or other power source.

When the fan 12 is used for blower door testing, an additional feature of the fan 12 is to provide one or more sensors to detect when the fan 12 has been secured into the blower door panel 102. Detection can be performed by any suitable form of sensor(s) including, but not limited to, a mechanical switch, a strain gauge, optical sensor, an RFID sensor, a proximity sensor, and the like. As blower door fans become lighter weight and higher powered, they are capable of moving abruptly if power is applied when the fan is not properly secured to the blower door panel. Control logic within the fan 12 can be provided to limit the maximum speed of the fan 12 to a safe level unless the sensor(s) detects that the fan 12 has been properly secured to the blower door panel, for example by the handle of the fan or by other mounting points.

Referring to FIG. 15, the fan described herein can be configured to implement a self-test mode that determines whether or not the fan is outputting an expected airflow. In the self-test mode, the fan is adjusted to a pre-assigned speed with a pre-assigned flow restriction, and the resulting differential pressure is then measured. It is then determined whether the measured differential pressure is within or outside of an expected range of differential pressures, and the fan is considered to pass or fail the test depending upon whether or not the measured pressure is within the expected range.

In FIG. 15, the self-test mode of the fan is initiated at 200. The self-test mode can be initiated manually or automatically. The self-test mode can be initiated periodically, on a pre-determined schedule, or before every new use of the fan in blower door test or duct leakage test. The fan (or the controller 14 in FIG. 1) can automatically initiate the self-test mode, or a reminder can be provided to the user via the fan or via the controller to manually initiate the self-test mode. In an embodiment, the fan may be prevented from operating until the self-test is performed.

The fan is operated at 202 with a pre-assigned or pre-determined speed, and with a pre-assigned or pre-determined flow restriction. As part of the self-test, the user can be instructed by the fan or the controller to set the fan at the pre-assigned speed. Alternatively, the fan can set itself to the pre-assigned speed, or the controller can set the fan to the pre-assigned speed. The user can also be instructed to set the fan with the pre-assigned flow restriction. In the case of the flow restrictor rings 50*a*-50*d* described above in FIG. 3, the instruction may include informing the user which flow restrictor ring 50*a-d* should be installed on the fan. Alternatively, in the case of the variable flow control valve 60 described above in FIG. 2, the instruction may inform the user to actuate the variable flow control valve 60 to the appropriate size. Alternatively, the pre-assigned flow restriction can be set automatically, for example by the fan automatically setting the flow restriction such as by automatically adjusting the variable flow control valve 60.

At 204, with the fan operating at the pre-assigned speed and with the pre-assigned flow restriction, the pressure is measured. For example, the pressure can be measured using the onboard pressure sensor 26 or any other pressure sensor. The measured pressure is then compared to a predetermined pressure range at 206. This comparison may be performed on the fan, for example using the data processor 28 and/or the fan controller 19, or on the controller 14, for example using the data processor 44. The predetermined pressure range may be stored on the fan, for example in the data storage 34, or stored on the controller 14, for example in the data storage 46. As part of the comparison at 206, a determination is made at 208 whether or not the measured pressure is within the predetermined range. Under ideal conditions with the fan operating at the pre-assigned speed and with the pre-assigned flow restriction, a resulting pressure would be expected. The predetermined pressure range can be any range of pressures that includes the expected resulting pressure that one may consider to be acceptable.

The upper end of the range and the lower end of the range may be equidistant from the expected resulting pressure (for example, ±5, ±10, ±15, etc. from the expected resulting pressure) or non-equidistant from the expected resulting pressure (for example +5 above and −15 below the expected resulting pressure). If the measured pressure is within the range, the fan is considered to pass the test at 210, and the fan can be used for its intended purpose such as conducting a blower door test or conducting duct leakage test. If the measured pressure is not within the range, the fan is considered to fail the test at 212. In a failure, a message can be provided to the user to not use the fan. In an embodiment, a suggestion can also be provided to the user that the fan needs maintenance. Alternatively, in the event of a failed test, a suggestion can be provided to the user to re-do the test, with the same speed and/or the same flow restriction, or with a different speed and/or different flow restriction. Or the fan can be used for its intended purpose with the operation of the fan adjusted to account for the measured pressure being outside the range.

In an embodiment, environmental variables that could impact the measured pressure can be factored in during the self-test. For example, the air pressure and/or the air temperature and/or altitude at the location of the fan can be factored into the self-test. For example, the fan can include a geotag so that the location of the fan is known, with the fan location being used to determine the altitude at that location. Alternatively, the fan location can be used to access a weather report indicating air pressure and/or air temperature at that location. Or real-time measurements of altitude, pressure and/or air temperature can be obtained using suitable sensors at the fan location.

Referring now to FIGS. 16-22, an example of a new blower door panel 300 is illustrated. The blower door panel 300 can be used with the smart fan 12 described above or used with any other blower door fan. As described in further detail below, the panel 130 includes a frame that is adjustable by the user in height and/or width to allow a user to adjust the size of the panel 300 to fit differently sized doorways. In one embodiment, the height and the width of the frame can be adjusted. In another embodiment, only the height of the frame can be adjusted. In still another embodiment, only the width of the frame can be adjusted.

Referring initially to FIG. 16, the panel 300 includes an air impermeable membrane 302 and a frame 304. The membrane 302 can be formed of any material that is suitable for use in a blower door panel for conducting blower door testing. For example, in one embodiment, the membrane 302 can be formed from coated nylon. An optional clear window 306, which can be made of vinyl or other transparent or translucent material, can optionally be provided in the membrane 302 to allow viewing inside of the building on which the blower door test is being conducted. The membrane 302 can be secured to the frame 304 whereby the frame 304 supports the membrane 302 during use. The membrane 302 and the frame 304 may be permanently secured to one another, or the membrane 302 may be removably secured to the frame 304, for example via hooks and loop fasteners or other non-permanent attachment mechanism. The membrane 302 also includes one or more fan openings 308 for mounting a fan to conduct a blower door test. The fan may be the smart fan 12 described above or any other blower door fan. Although only one opening 308 is depicted, one or more additional fan openings can be provided in the membrane 302 for supporting one or more additional fan on the panel 300 during a blower door test.

With continued reference to FIG. 16, the frame 304 is arranged adjacent to the perimeter of the membrane 302. The frame 304 is formed by a number of frame members 304*a*, 304*b*, 304*c*, 304*d*, 304*e*. However, a smaller or larger number of frame members can be used. The terms right, left, top and bottom are in reference to the view shown in FIG. 16. The frame members 304*a*, 304*b* extend generally from the top edge of the membrane 302 to the bottom edge with the frame member 304*a* being located at the right side of the membrane 302, and the frame member 304*b* being located at the left side. The frame members 304*c*, 304*d*, 304*e* extend generally from the right side of the membrane 302 to the left side, with the frame member 304*c* being located at the bottom edge of the membrane 302, the frame member 304*d* being located at the top edge, and the frame member 304*e* being located between the top edge and the bottom edge, for example just above the fan opening 308 for use in support the fan when the fan is mounted in the opening 308. One or more additional frame members 304*f* (depicted in broken lines), which can be similar to the frame member 304*e*, can be arranged between the frame member 304*e* and the upper frame member 304*d*. The frame members 304*a-e* can be removably attached to one another, for example at or near their ends, to permit the frame 304 to be disassembled when not in use. Any type of removable connection can be used including, but not limited to, mechanical fasteners, tongue and groove connections, or the like.

The frame members 304*a-e* are generally identical in construction and operation. Therefore, only the construction and operation of the frame member 304*a* will be described in detail, with it being understood that the frame members 304*b-e* have the same construction and operation. Referring initially to FIGS. 16 and 17, the frame member 304*a* has two frame portions 310*a*, 310*b* that are slidably attached to each other to allow the frame portions 310*a*, 310*b* to longitudinally slide relative to one another to adjust (increase or decrease) the length of the frame member 304*a*. In particular, the frame portions 310*a*, 310*b* are movable from a collapsed configuration, where the frame portions 310*a*, 310*b* have a minimum length for example when not in use, to a desired expanded length during use. The frame portions 310*a*, 310*b* can be formed of any material that is suitable for use in forming the frame 304. For example, each frame portion 310*a*, 310*b* can be formed of metal such as aluminum, plastic, or any other material. The frame portions 310*a*, 310*b* can be extruded, cast, formed by additive manufacturing, or formed in any other manner.

In addition, the frame member 304*a* includes a one-way self-locking length controller 312 that selectively controls the relative longitudinal movements between the frame portions 310*a*, 310*b*. For example, in an embodiment, the one-way self-locking length controller 312 can be configured to have a home position or a home configuration that permits one-way relative longitudinal movements between the frame portions 310*a*, 310*b* in a direction to increase the length of the frame member 304*a*, but self-locks to prevent relative longitudinal movements between the frame portions 310*a*, 310*b* in an opposite direction, i.e. in a direction to decrease the length of the frame member 304*a*. However, the one-way self-locking length controller 312 can be actuated by a user to a release position or a release configuration to allow the length of the frame member 304*a* to be decreased.

The one-way self-locking length controller 312 can have any configuration that permits an increase in the length of the frame member 304*a* (permitting relative sliding movement of the frame portions 310*a*, 310*b*) when a user slides the frame portions 310*a*, 310*b* apart, but automatically locks and prevents a decrease in the length of the frame member 304*a* (prevents relative sliding movement of the frame portions 310*a*, 310*b*) unless and until the one-way self-locking length controller 312 is actuated to a release position.

For example, FIGS. 17-23 illustrate one version where the one-way self-locking length controller 312 is configured similar to a ratchet. In this version, the frame portions 310*a*, 310*b* are each configured as generally rectangular, hollow structures with a channel or opening 314 along the length thereof. Each frame portion 310*a*, 310*b* includes a base wall 316, side walls 318*a*, 318*b* extending from the base wall 316, and rails 320*a*, 320*b* that extend from the side walls 318*a*, 318*b* toward one another to define the channel 314. In operation, referring specifically to FIG. 23A, the frame portion 310*b* is inverted relative to the frame portion 310*a*, with the rail 320*b* of the frame portion 310*b* sliding on the rail 320*a* of the frame portion 310*a*, and the rail 320*a* of the frame portion 310*b* sliding on the rail 320*b* of the frame portion 310*a*.

The one-way self-locking length controller 312 includes an array of detents 322, for example on the base wall 316 of the frame portion 310*a*. See FIGS. 18 and 20. The one-way self-locking length controller 312 further includes a leaf spring 324, best seen in FIGS. 19 and 21 that controllably interacts with the detents 322 to control movement of the frame portions 310*a*, 310*b* relative to one another.

The detents 322 can have any configuration that is suitable for interacting with the leaf spring 324 in the manner described below. In general, referring to FIGS. 18-20, each detent 322 includes an angled ramp surface 326 and a locking side 328. The detents 322 are configured such that the leaf spring 324 is able to slide up and over the ramp surfaces 326 and then snap behind the locking side 328 when the frame portions 310*a*, 310*b* are moved relatively to one another during expansion (see arrows A in FIG. 17) of the frame member 304*a*. In addition, the detents 322 are also configured such that the leaf spring 324 abuts against the locking side 328 and prevents movements of the frame portions 310*a*, 310*b* relative to one another towards the collapsed configuration (see arrows B in FIG. 17) of the frame member 304*a* until the one-way self-locking length controller 312 is actuated to a release position. In one embodiment, the detents 322 can be formed by partial cut-outs formed in the base wall 316, with one edge of material remaining attached the base wall 316 and the rest of the cut-out material being bent upward at an angle. In another embodiment, the detents 322 can be formed by protruding material formed on the base wall 316. Other forms of the detents 322 are possible.

Referring to FIGS. 19 and 21, the leaf spring 324 is a resilient element with a fixed end 330 that is configured for mounting the leaf spring 324 and a resilient or flexible end 332 that is normally biased downward in a direction toward the base wall 316 of the frame portion 310 and that is intended to interact with the detents 322. The resilient end 332 of the leaf spring 324 is normally biased into engagement with the detents 322 as depicted in FIG. 19. However, the resilient end 332 of the leaf spring 324 is able to be raised upward above the detents 322 by a pin 334 to form the release position as described below that is connected to the leaf spring 324. When the resilient end 332 is raised upward above the detents 322, the resilient end 332 is no longer able to engage with the detents 322 and the frame portions 310*a*, 310*b* are able to be actuated to the collapsed configuration in the direction of the arrows B in FIG. 17.

In an embodiment, and referring to FIGS. 20 and 21, the detents 322 can be arranged into two sets 336*a*, 336*b* arranged side-by-side, and each set 336*a*, 336*b* includes two rows 338*a*, 338*b* of the detents 322. As seen in FIG. 20, the sets 336*a*, 336*b* are longitudinally offset from one another. In addition, within each set 336*a*, 336*b*, the rows 338*a*, 338*b* are offset from one another by a distance D. The distance D can be the same in each set 336*a*, 336*b*. In one non-limiting embodiment, the distance D can be about 0.0625 inch (or about 1.6 mm). In addition, referring to FIG. 21, the resilient end 332 of the leaf spring 324 is bifurcated into two resilient portions 332*a*, 332*b*. The resilient portion 332*a* interacts with the detents 322 in the set 336*a* while the resilient portion 332*b* interacts with the detents 322 in the set 336*b*. Because of the offsetting of the sets 336*a*, 336*b* and the detents within the rows 338*a*, 338*b*, only one of the resilient portions 332*a*, 332*b* may actually be in a locking position with one of the detents 322 in one of the sets 336*a*, 336*b* and rows 338*a*, 338*b* at any time. The detent sets 336*a*, 336*b* and the offsetting of the detents 322, together with the two resilient portions 332*a*, 332*b*, provides the one-way self-locking length controller 312 with a large number of locked positions and a corresponding large number of incremental length adjustment positions for the frame member 304*a*. With the distance D of about 0.0625 inch (or about 1.6 mm), the one-way self-locking length controller 312 provides the frame member 304*a* with substantially infinite length adjustment.

Referring now to FIGS. 18, 19, 22 and 23A-B, the frame portions 310*a*, 310*b* are connected to one another by a connector 350. Referring initially to FIG. 19, the connector 350 includes a first portion 352 disposed within the frame portion 310*a* with a boss 354 that extends upwardly through the channel 314 of the frame portion 310*a*. The first portion 352 further includes a boss 356 that extends upwardly through the channel 314 of the frame portion 310*b*. As best seen in FIGS. 19 and 23A-B, the fixed end 330 of the leaf spring 324 is fixed to the base of the boss 354. Referring to FIG. 19, the pin 334 extends upwardly through a passage in the first portion 352 and in the boss 354, and the pin 334 includes an end 358 that projects above the end of the boss 354. Referring to FIGS. 18 and 19, the end 358 is secured to a lateral pin 360 of a cam lever 362. The cam lever 362 includes a pair of cams 364 that are disposed around the lateral pin 360 and are rotatable relative thereto, and a lever 366 that can rotate the cams 364. The other end of the pin 334 extends between the two resilient portions 332*a*, 332*b* and a nut 368 is secured to the pin 334. In addition, a second cam lever 370 is disposed around and rotatable relative to the boss 354.

Referring to FIGS. 17-19 and 22, the cam lever 362 is initially in the position illustrated, which may be referred to as a home position, where the one-way self-locking length controller 312 permits one-way relative longitudinal movements between the frame portions 310*a*, 310*b* in a direction to increase the length of the frame member 304*a*, but self-locks to prevent relative longitudinal movements between the frame portions 310*a*, 310*b* in an opposite direction, i.e. in a direction to decrease the length of the frame member 304*a*. In this position, the leaf spring 324 is in a down position and the resilient portions 332*a*, 332*b* are engageable with the detents 322. The frame portions 310*a*, 310*b* are able to be moved relative to one another in the direction of the arrows A in FIG. 17 to increase the length of the frame member 304*a*.

Referring to FIG. 24, in one embodiment one or both of the frame portions 310*a*, 310 can include a scale 372 thereon to assist a user in determining the extended length of the frame member 304*a*. For example, FIG. 24 illustrates the scale 372 as being disposed on the frame portion 310*a*. However, the scale 372 can be disposed on the frame portion 310*b*, or each frame portion 310*a*, 310*b* can include parts of the scale 372. The scale 372 can be in any desired units of measure such as inches, centimeters, millimeters, or the like. In another embodiment, the scale 372 can include non-numeric indicators of length, such as indicators based on type of doorway or indicators based on a geographic location where the testing is taking place. For simplicity, the one-way self-locking length controller is not depicted in FIG. 24. However, the frame member 304*a* would include the self-locking length controller 312 described above.

Returning to FIGS. 17-19 and 22, engagement between one or more of the resilient portions 332*a*, 332*b* and one or more of the locking sides 328 of the detents 322 prevents the frame portions 310*a*, 310*b* from being moved relative to one another in the direction of the arrows B to the collapsed configuration. Once the desired length of the frame member 304*a* is achieved, the second cam lever 370 is rotated 90 degrees in a clockwise direction when viewing FIG. 17 about the axis of the boss 354 and about the axis of the pin 334 from the position shown in FIGS. 17 and 18. This causes a cam surface 374 on the second cam lever 370 to push against the end of the frame portion 310*b* which forces the frame portion 310*a* and the frame portion 310*b* a small distance away from one another to help securely lock in the frame member 304*a* in the doorway.

To permit movement of the frame portions 310*a*, 310*b* relative to one another in the direction of the arrows B to the collapsed configuration, the cam lever 362 is rotated 90 degrees upward about the lateral pin 360 and the axis thereof in the direction of the arrow in FIG. 22 so that the lever 366 is vertical. When this occurs, the cams 364 push on the boss 354 which forces the pin 334 upward (when viewing FIG. 19) which pulls the nut 368 upward which lifts the resilient end 332 of the leaf spring 324 upward. The resilient end 332 of the leaf spring 324 no longer can engage with the detents 322 and the frame portions 310*a*, 310*b* can then be moved in the direction of the arrows B to the collapsed configuration.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A smart fan, comprising:

a fan housing defining a flow path;

an electric drive motor;

a propeller in engagement with and driven by the electric drive motor for generating a flow through the flow path;

a display screen on the fan housing;

a communication transceiver;

a variable flow restrictor that restricts flow through the smart fan, and a variable flow restrictor detector;

at least one pressure sensor positioned on the fan for measuring at least pressure of the flow through the smart fan;

a data processor electrically connected to the display screen, the communication transceiver, the variable flow restrictor and the variable flow restrictor detector, the at least one pressure sensor, and the electric drive motor; and data storage in communication with the data processor, wherein the data processor is configured to determine the flow through the smart fan to test for air leakage in a building or duct work, wherein the variable flow restrictor comprises one or more flow restrictor rings that are each removably mountable on the smart fan, and wherein the variable flow restrictor detector is configured to detect which ones of the one or more flow restrictor rings are mounted on the smart fan.

2. The smart fan of claim 1, further comprising one or more of:

one or more batteries providing electrical power to the electric drive motor;

a duct removably attached to the smart fan and a duct detector that detects the presence of the duct; and a flow conditioner attached to the smart fan and a flow conditioner detector that detects the presence of the flow conditioner.

3. The smart fan of claim 1, wherein the variable flow restrictor comprises a variable flow control valve, and wherein the variable flow restrictor detector is configured to detect a position of the variable flow control valve.

4. The smart fan of claim 3, wherein the smart fan is configured to operate in a self-test mode where the fan operates at a pre-assigned speed and with a pre-assigned flow restriction provided by the variable flow restrictor.

5. The smart fan of claim 4, wherein the self-test mode is initiated manually or automatically.

6. A blower door test system, comprising:

the smart fan of claim 1; and a blower door panel on which the smart fan is mounted that mounts the smart fan in a door or window.

7. A duct leakage test system, comprising:

the smart fan of claim 1; and a duct having a first end thereof connected to the smart fan, and a second end thereof connected to an HVAC system.

8. A blower door test system, comprising:

at least two fans of claim 1;

a blower door panel on which the at least two fans are mounted that mounts the at least two fans in a door or window;

a source of electrical power separate from the at least two fans and electrically connected to each one of the at least two fans to simultaneously provide electrical power to each one of the at least two fans.

9. The blower door test system of claim 8, wherein the source of electrical power comprises a wall outlet, one or more batteries, or a generator.

10. The blower door test system of claim 8, wherein the at least two fans are vertically positioned on the blower door panel one above the other.

11. The smart fan of claim 1, further comprising at least one pressure sensor positioned on the smart fan and configured to detect a pressure of the flow through the flow path.

12. The smart fan of claim 1, wherein the one or more flow restrictor rings have different diameters and the variable flow restrictor detector is configured to detect which ones of the one or more flow restrictor rings are mounted and diameter of the mounted one or more flow restrictor rings.

13. The smart fan of claim 12, wherein the one or more flow restrictor rings having the different diameters are configured to nest within and be removably secured to each other.

* * * * *